US011473366B2

(12) United States Patent
Gaviglia

(10) Patent No.: US 11,473,366 B2
(45) Date of Patent: Oct. 18, 2022

(54) HEMP SHIELDED SLIDING DOOR SYSTEM AND METHOD

(71) Applicant: Gaven Industries, Inc., Saxonburg, PA (US)

(72) Inventor: John J. Gaviglia, Glenshaw, PA (US)

(73) Assignee: Gaven Industries, Inc., Saxonburg, PA (US)

( * ) Notice: Subject to any disclaimer, the term of this patent is extended or adjusted under 35 U.S.C. 154(b) by 742 days.

(21) Appl. No.: 16/443,237

(22) Filed: Jun. 17, 2019

(65) Prior Publication Data

US 2019/0383089 A1 Dec. 19, 2019

Related U.S. Application Data

(60) Provisional application No. 62/685,732, filed on Jun. 15, 2018.

(51) Int. Cl.
*E05F 15/646* (2015.01)
*E06B 5/18* (2006.01)
(Continued)

(52) U.S. Cl.
CPC ..... *E06B 5/18* (2013.01); *E04B 1/92* (2013.01); *E05D 15/0604* (2013.01);
(Continued)

(58) Field of Classification Search
CPC ..... E06B 7/2318; E06B 5/18; E06B 3/5072; E06B 7/16; E06B 5/20; E04B 2001/925;
(Continued)

(56) References Cited

U.S. PATENT DOCUMENTS 2,019,664 A 11/1935 Farmer
3,055,969 A 9/1962 Schaller, Jr.
(Continued)

OTHER PUBLICATIONS

Department of Defense Interface Standard, High-Altitude Electromagnetic Pulse (HEMP) Protection for Ground-Based C4I Facilities Performing Critical, Time-Urgent Missions, Part 1 Fixed Facilities; MIL-STD-188-125-1-1; Jul. 17, 1998.
(Continued)

*Primary Examiner* — Justin B Rephann
(74) *Attorney, Agent, or Firm* — David G. Oberdick

(57) ABSTRACT

A sliding door system and method is used in an enclosure that defines an inner area shielded against a High-Altitude Electromagnetic Pulse ("HEMP"). The HEMP shielded sliding door system includes an RF shielding door frame, an RF shielding door leaf mounted within an mechanical door leaf frame, a mechanical insertion and retraction assembly attached to both the mechanical door leaf frame and RF shielding door leaf and that operates to extend and retract the RF shielding door leaf into and out of the RF shielding door frame, a drive tube assembly operable to interact with and open and close mechanical door leaf frame (along with RF shielding door leaf) in a sliding motion, and a control assembly, including motor and an air regulator assembly. HEMP shielding air seals are activated when the RF shielding door leaf is inserted into the RF shielding door frame.

20 Claims, 28 Drawing Sheets

(51) Int. Cl.

| | |
|---|---|
| ***E05D 15/06*** | (2006.01) |
| ***E06B 7/23*** | (2006.01) |
| ***E06B 3/50*** | (2006.01) |
| ***E05D 15/48*** | (2006.01) |
| ***E04B 1/92*** | (2006.01) |

(52) U.S. Cl.
CPC ..... *E05D 15/48* (2013.01); *E05F 15/646* (2015.01); *E06B 3/5072* (2013.01); *E06B 7/2318* (2013.01); *E04B 2001/925* (2013.01); *E05D 2015/485* (2013.01); *E05Y 2900/132* (2013.01)

(58) Field of Classification Search
CPC ..... E04B 1/92; E05F 15/646; E05F 15/643; E05D 15/0604; E05D 15/48; E05D 15/485; E05D 2015/485; E05Y 2900/132
See application file for complete search history.

(56) References Cited

U.S. PATENT DOCUMENTS 3,132,893 A 5/1964 Madland
3,435,794 A 4/1969 Pechacek
3,437,735 A 4/1969 Schaller
3,449,864 A 6/1969 Prost-Dame et al.
3,507,974 A 4/1970 Clark et al.
3,747,275 A 7/1973 May et al.
3,984,942 A * 10/1976 Schroth ..... B60J 10/244 49/495.1
4,150,509 A * 4/1979 Knap ..... E05F 1/16 49/411
4,371,175 A 2/1983 Van Dyk, Jr.
4,561,209 A 12/1985 Sohlstrom
4,571,449 A 2/1986 Lindenberger
4,691,483 A 9/1987 Anderson
4,722,151 A 2/1988 Westwell
4,750,569 A 6/1988 Flogaus
4,902,851 A 2/1990 Richter
4,929,802 A 5/1990 Schaepers et al.
5,013,869 A 5/1991 Breithaupt
5,085,293 A 2/1992 Aime
5,214,241 A 5/1993 Benwell
5,223,670 A 6/1993 Hogan
5,250,751 A 10/1993 Yamaguchi
5,569,878 A 10/1996 Zielinski
5,736,671 A 4/1998 Perala
5,749,175 A 5/1998 Koike et al.
6,170,203 B1 1/2001 Schlapfer
6,323,419 B1 11/2001 Toy
6,519,899 B1 2/2003 Hurzeler
6,626,264 B1 9/2003 Christen
6,914,184 B1 7/2005 Lahita
7,117,640 B2 10/2006 Hurzeler
7,152,375 B1 12/2006 Mastro
7,246,681 B2 7/2007 Christen
7,491,898 B2 2/2009 Villanella
7,578,097 B2 * 8/2009 Dondlinger ..... F25D 23/087 49/118
8,522,484 B2 * 9/2013 Gaviglia ..... E06B 7/2301 174/374
8,595,983 B2 * 12/2013 Gaviglia ..... E06B 7/2318 49/501
8,800,209 B2 * 8/2014 Gaviglia ..... E06B 7/2318 49/477.1
9,151,104 B2 * 10/2015 Gaviglia ..... E06B 1/18
10,604,995 B2 * 3/2020 Kang ..... E06B 7/2318
2005/0060937 A1 * 3/2005 Dondlinger ..... F25D 23/087 49/118
2005/0150169 A1 * 7/2005 Schulte ..... E06B 3/4636 49/410
2007/0084126 A1 * 4/2007 Hautmann ..... E06B 5/18 49/483.1
2007/0151162 A1 7/2007 Thielmann et al.
2011/0061301 A1 * 3/2011 Gaviglia ..... E06B 7/2318 49/70
2011/0107674 A1 * 5/2011 Sauter ..... E06B 7/2318 49/316
2011/0258934 A1 * 10/2011 Gaviglia ..... E06B 7/2318 49/477.1
2011/0271598 A1 * 11/2011 Gaviglia ..... E06B 1/52 49/506
2014/0000209 A1 * 1/2014 Gaviglia ..... E06B 1/18 29/897.3
2014/0069020 A1 * 3/2014 Gaviglia ..... E06B 7/2318 49/506
2019/0032392 A1 * 1/2019 Cordes ..... E06B 7/2301
2019/0315448 A1 * 10/2019 Chavez ..... E06B 7/2318
2021/0404245 A1 * 12/2021 Satrom ..... E06B 7/2303

OTHER PUBLICATIONS

Department of Defense Interface Standard, High-Altitude Electromagnetic Pulse (HEMP) Protection for Ground-Based C4I Facilities Performing Critical, Time-Urgent Missions, Part 2 Transportable Systems; MIL-STD-188-125-2-2; Mar. 3, 1999.
http://www.jaycor.com, 4 pages, Jul. 14, 2009.
ETS-Lindgren, An ESCO Technologies Company, Auto-Seal II Door RF-Shieled, Acoustic and Fire-Rated, Sales Brochure, Copyright 2003.
Office Action for U.S. Appl. No. 13/091,448 dated Oct. 11, 2012.
Office Action for U.S. Appl. No. 13/091,448 dated Apr. 11, 2013.
Office Action for U.S. Appl. No. 13/104,278 dated Oct. 23, 2012.
Office Action for U.S. Appl. No. 13/104,278 dated Nov. 23, 2012.

* cited by examiner

HEMP SHIELDED SLIDING DOOR SYSTEM AND METHOD

CROSS-REFERENCE TO RELATED APPLICATIONS

This application claims priority to U.S. Provisional Application Ser. No. 62/685,732, filed Jun. 15, 2018, which application is incorporated by reference herein in its entirety.

FIELD OF THE INVENTION

This invention relates to a sliding door system and method providing radio frequency ("RF) shielding against a High-Altitude Electromagnetic Pulse (HEMP).

BACKGROUND OF INVENTION

The detonation of a nuclear device in or above the Earth's atmosphere produces an intense, time-varying electromagnetic field (electromagnetic pulse or EMP). When such an event takes place above 30 km, it is defined as a HEMP effect and can affect a vast area. Separately, a smaller localized HEMP event can be produced without the need for a nuclear detonation above the atmosphere. For example, detonation of a weapon at lower altitudes also will produce an electromagnetic pulse that may be less intense, but will still be strong enough to induce fields that can cause critical systems in a smaller more localized area to malfunction because of circuit damage.

The U.S. military, among others, has undertaken the responsibility of establishing a HEMP-hardened electrical parameter shield or barrier for mission critical military operations that will ensure system survivability during a HEMP event. Creating an electromagnetic shield or barrier that will prevent or limit HEMP or localized EMP fields or conducted transients from entering the shielded area is primary. The HEMP shield and all points of entry (POE) must be treated properly to maintain shield integrity.

HEMP-shielded POEs are, of necessity, thick and heavy. This structure makes the use, installation and maintenance of HEMP-shielded doors difficult and cumbersome. While sliding HEMP-shielded doors have been used in the past, it has been difficult to create an effective HEMP seal between the door and frame. As such, there is a need for a sliding HEMP-shielded door that is easy to operate and that creates an effective HEMP seal between the door and frame.

SUMMARY OF THE INVENTION

The present invention provides an improved sliding door as a POE for protection against the effects of a HEMP event. In particular, the present invention provides a novel sliding system and method for a HEMP-shielded door for ease of use in opening and closing the door through use of a mechanical assembly for insertion of a door leaf with electromagnetic shielding that blocks radio frequency or RF electromagnetic radiation ("RF shielding") into an door frame with RF shielding. When not inserted into the RF shielding door frame, the RF shielding leaf is mounted within and carried by a mechanical door leaf frame on which the RF shielding door leaf is mounted. The mechanical door leaf frame, and the RF shielding door leaf mounted on the mechanical door leaf frame, slide between open and closed positions. When the mechanical door leaf aligns with the RF shielding door frame, a mechanical insertion and retraction assembly is automatically activated and operates to insert the RF shielding door leaf into the RF shielding door frame. Upon full insertion, HEMP shielding air seals around the perimeter of the RF shielding door leaf are activated automatically and inflated, whereby a HEMP-shielded POE is created. The RF shielding door leaf is retracted by a reverse operation; that is, the HEMP shielding air seals are deflated, which triggers the mechanical insertion and retraction assembly to retract the RF shielding door leaf into the mechanical door leaf frame. Upon full retraction, the mechanical door leaf frame automatically slides to an open position.

The sliding door system and method of the present invention meets government standards for HEMP shielding.

The invention further includes a failsafe feature whereby the RF shielding door leaf retracts from the RF shielding door frame in the event of a power failure. In this event, the sliding door also can be manually moved, by sliding, to an open position.

In addition, the RF shielding door leaf can pivot inward, when in the open position and mounted within the mechanical door leaf frame, for ease of maintenance or replacement of inflatable RF seals.

DETAILED DESCRIPTION OF THE INVENTION

Figure 1:
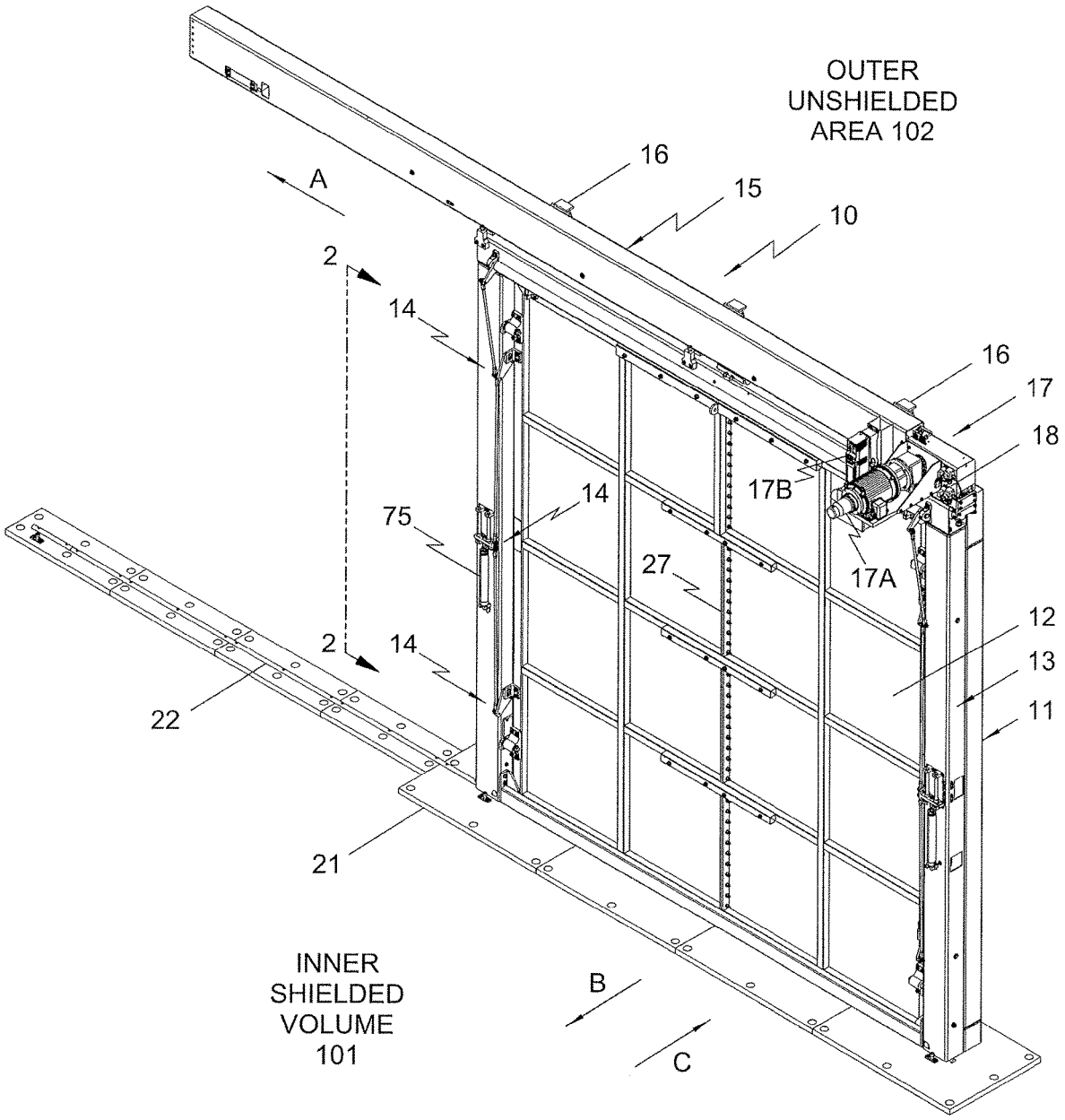
FIG. 1 is a front right perspective view of one embodiment of the door assembly of the present invention, with the mechanical door leaf frame aligned with the RF shielding door frame before insertion of the RF shielding door leaf into the RF shielding door frame.
Figure 2:
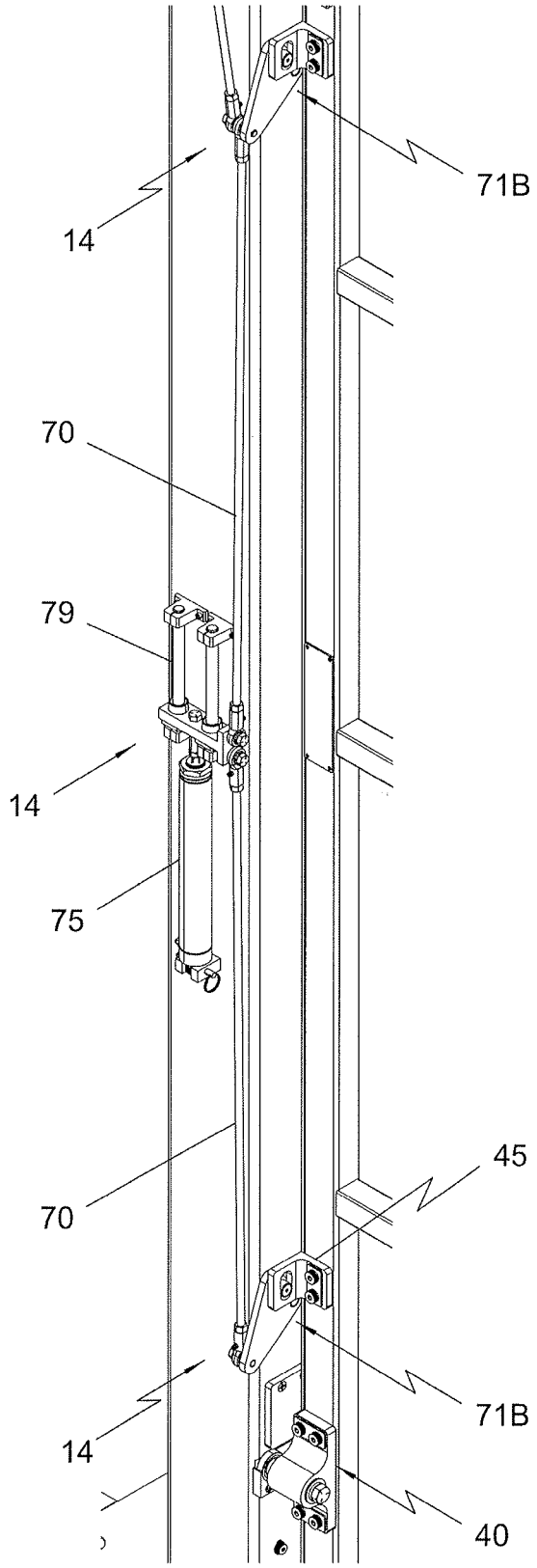
FIG. 2 is a front right perspective view of one side of the mechanical insertion and retraction assembly of the door assembly shown in FIG. 1.

As shown in FIG. 1, sliding door assembly 10 is part of an enclosure that defines an outer unshielded area 102 and an inner shielded volume 101. Referring to FIGS. 1-10, one embodiment of the HEMP shielded sliding door assembly 10 of the present invention includes an RF shielding door frame 11, an RF shielding door leaf 12 mounted within an mechanical door leaf frame 13, a mechanical insertion and retraction assembly 14 which is attached to both mechanical door leaf frame 13 and RF shielding door leaf 12 and operates to extend and retract the RF shielding door leaf 12 into and out of the RF shielding door frame 11, a drive tube assembly 15 attached by brackets 16 to RF shielding door frame 11 and operable to interact with and open and close mechanical door leaf frame 13 (along with RF shielding door leaf 12) in a sliding motion, and a control assembly 17, including motor 17A and air regulator assembly 18 mounted on drive tube assembly 15. The method of the present invention involves use of sliding door assembly 10 to control the opening and closing of RF shielding door leaf 12 mounted within an mechanical door leaf frame 13, and the insertion of RF shielding door leaf 12 into RF shielding door frame 11 in order to create a HEMP-shielded point of entry or POE by inflation of HEMP shielding area seals 30 mounted on the perimeter of RF shielding door leaf 12. When inflated, air seals contact and form a HEMP shielding seal with RF shielding door frame 11 and an RF shielding floor plate 21 on which RF shielding door frame 11 is mounted.

More specifically, the RF shielding door frame 11 is oriented in a substantially vertical plane with an internal aperture 99. The RF shielding door leaf 12 is mounted within an internal aperture 100 of the mechanical door leaf frame 13 when mechanical door leaf frame 13 is in an open position and also when mechanical door leaf frame 13 is being moved to and from a closed position. The mechanical door leaf frame 13 is oriented in a substantially vertical plane parallel to the vertical plane of the RF shielding door frame 11. The mechanical door leaf frame 13 is slidably mounted on and supported by a longitudinal rail 22 on an RF shielding floor plate or threshold 21, and the sliding motion of mechanical door leaf frame 13 is controlled by connection of mechanical door leaf frame 13 to, and related interaction with, the drive tube assembly 15.

Figure 15:
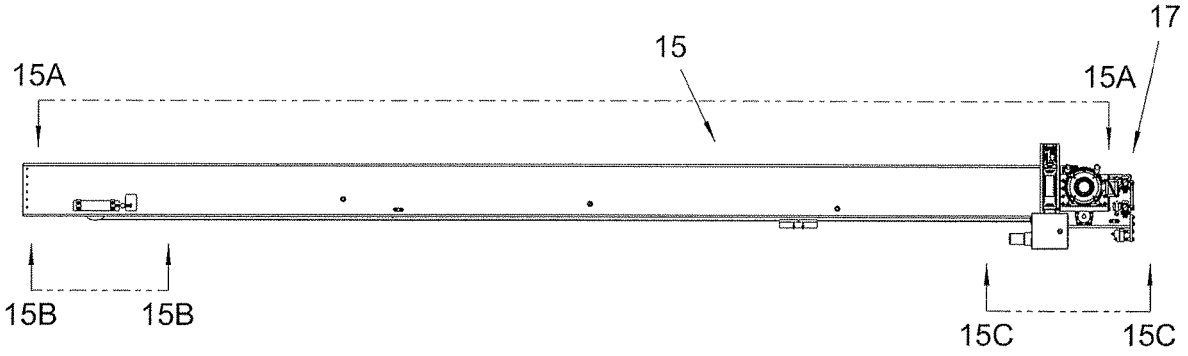
FIG. 15 is a front view of the drive tube assembly of the door assembly shown in FIG. 1.
Figure 15A:
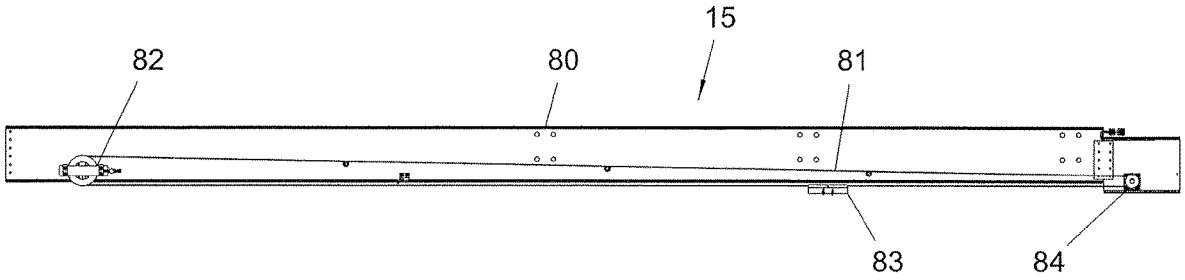
FIG. 15A is front sectional cut-out view of the drive tube assembly of the drive tube assembly shown in FIG. 15.
Figure 15B:
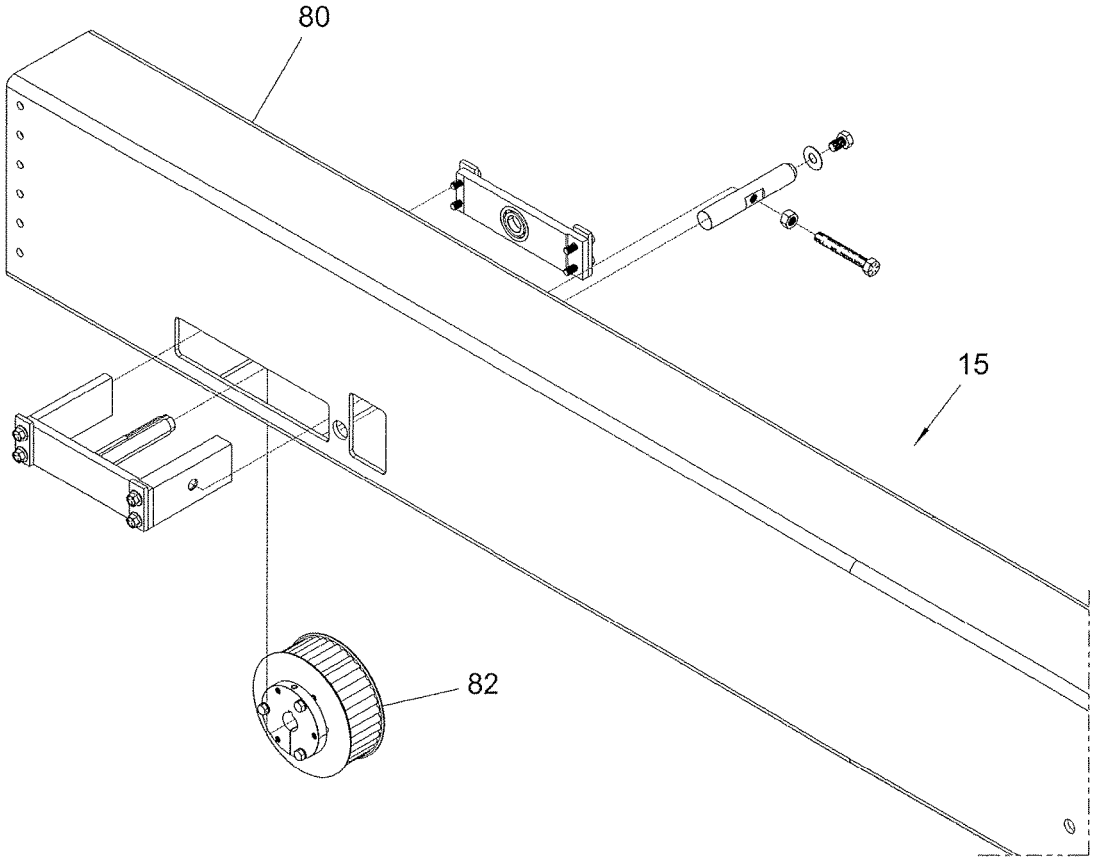
FIG. 15B is a perspective sectional telescoping view of the timing belt tensioner of the drive tube assembly shown in FIG. 15.
Figure 15C:
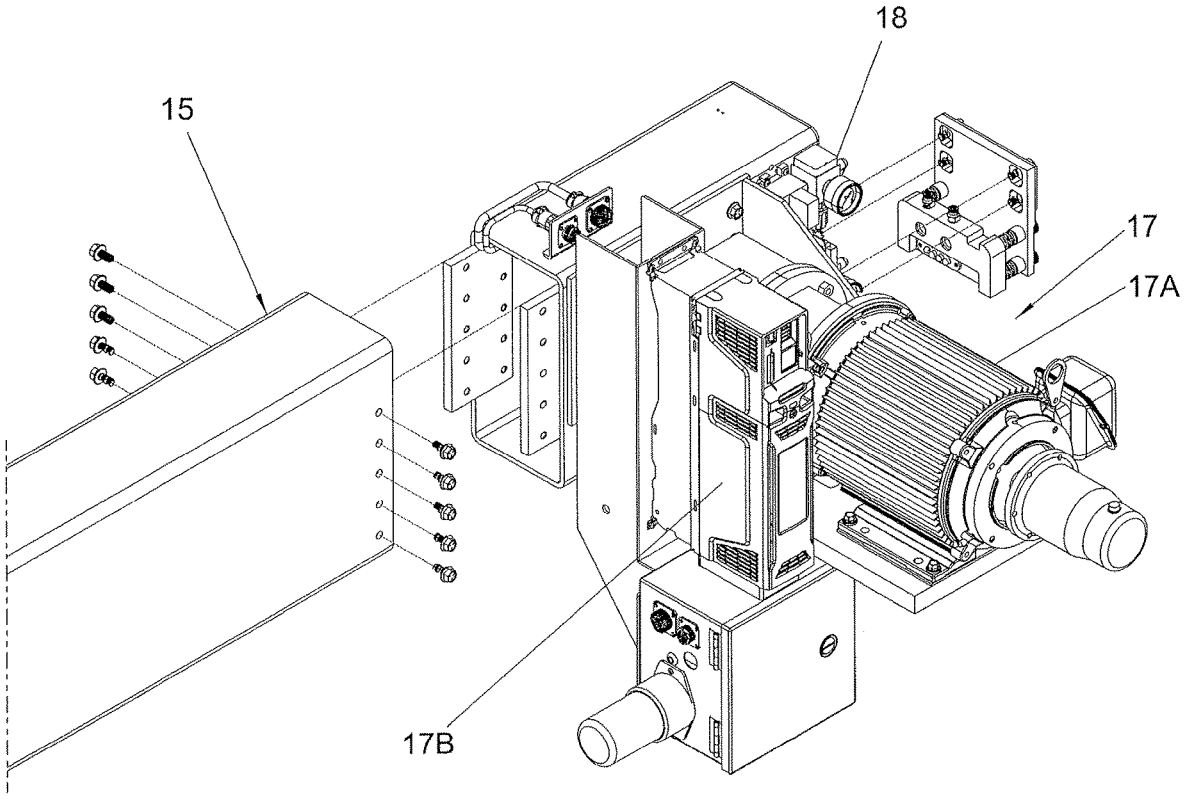
FIG. 15C is a perspective view of the control assembly associated with the drive assembly shown in FIG. 15.
Figure 16:
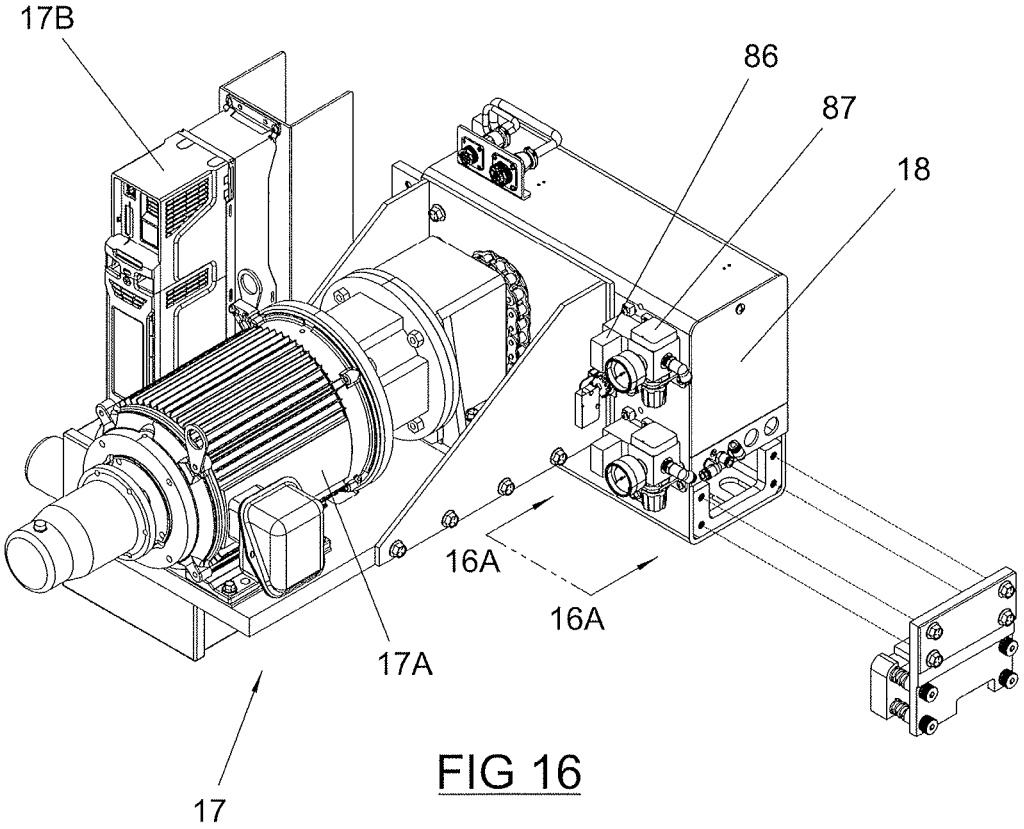
FIG. 16 is a perspective view of the air regulator associated with the control assembly shown in FIG. 15C.

In one embodiment, the drive tube assembly 15 is controlled by control assembly 17 which, in one embodiment, is mounted on drive tube assembly 15 and includes motor 17A, a motor drive or programmable logic controller ("PLC") 17B, and an air regulator assembly 18 (shown in FIG. 16). In particular, motor 17A interacts with a belt 81 (shown in FIG. 15A) to activate and control sliding movement of the mechanical door leaf frame 13 along the length of the motor tube assembly 15 and rail 22. In other embodiments, other types of drive assemblies can be used.

Figure 3:
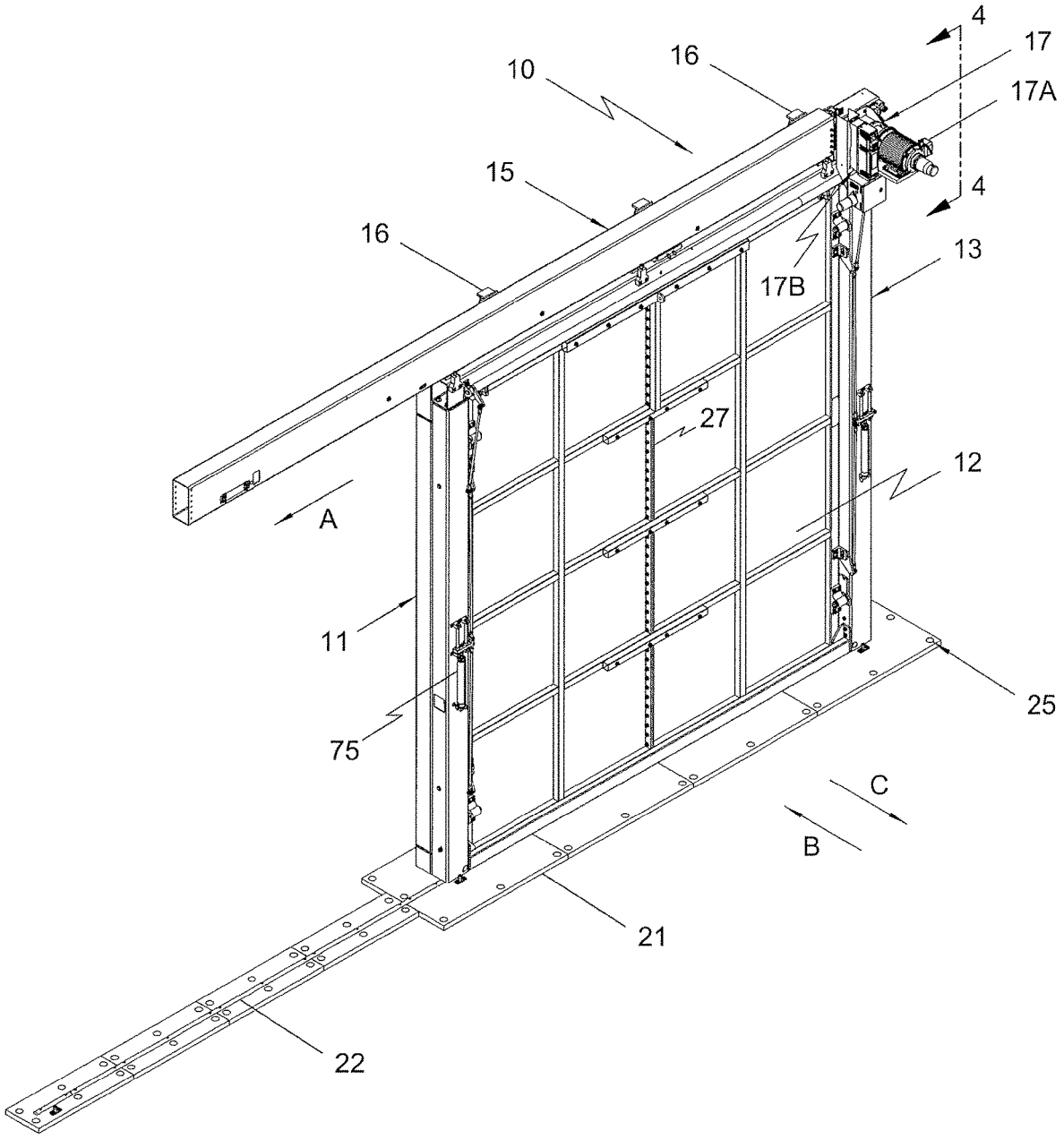
FIG. 3 is a front left perspective view of the door shown in FIG. 1.
Figure 4:
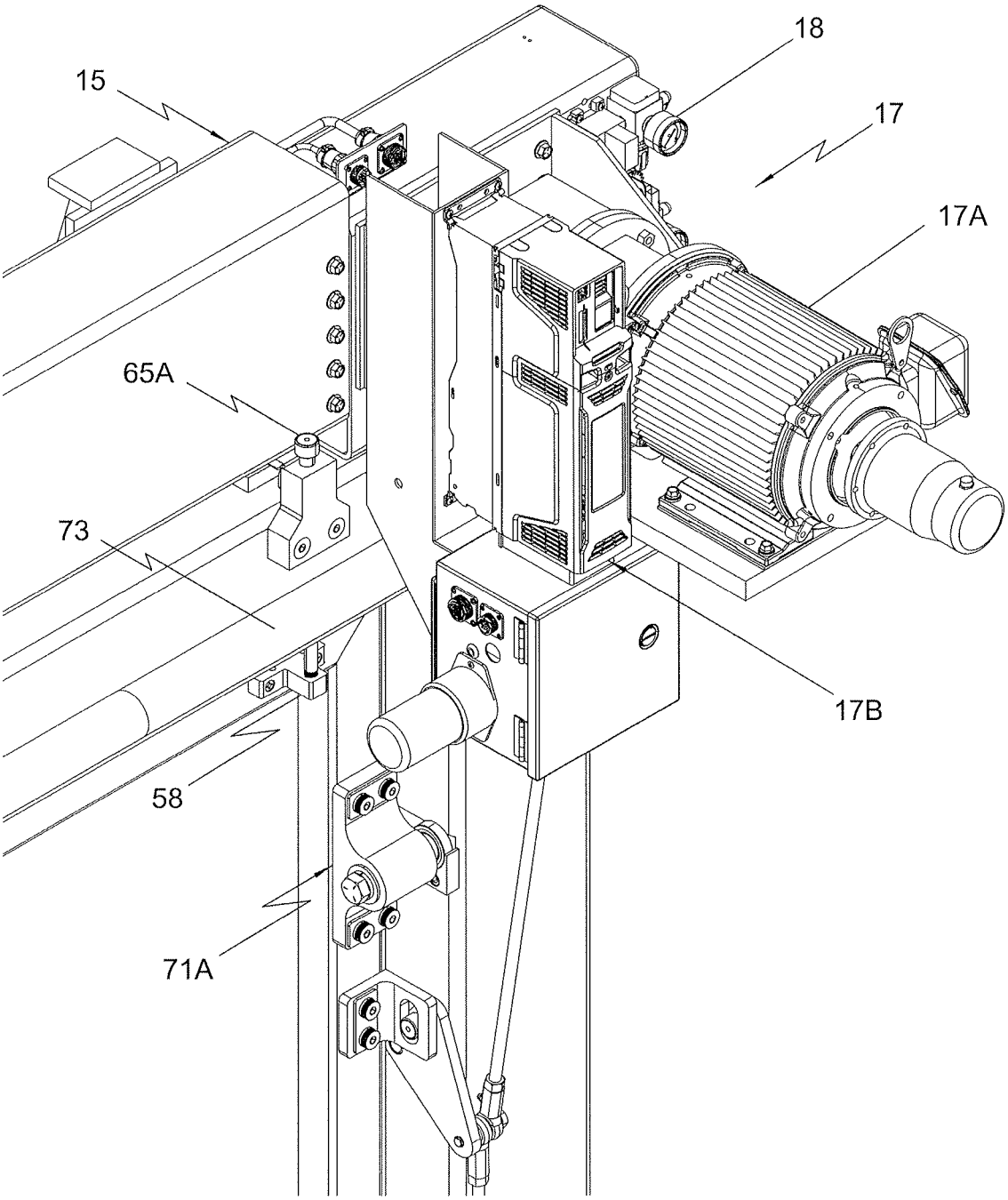
FIG. 4 is a front left perspective view of the upper right corner of the door shown in FIG. 3, including the motor and a portion of the corresponding side of the mechanical insertion and retraction assembly of the present invention.

In FIGS. 1 and 3, the mechanical door leaf frame 13 and associated RF shielding door leaf 12 open by sliding to the left as shown by arrow A. In other embodiments, the mechanical door leaf frame 13 and associated RF shielding door leaf 12 can open by sliding to the right. The mechanical insertion and retraction assembly 14 includes an activator to activate and control the insertion and retraction of RF shielding door leaf 12 into and out of the RF shielding door frame 11, as shown by arrows B and C, respectively, in FIGS. 1 and 3. The movement of RF shielding door leaf 12 into and out of the RF shielding door frame 11 automatically occurs when the internal aperture 100 of the mechanical door leaf frame aligns with the internal aperture 99 of the RF shielding door frame in the closed position. In particular, such alignment triggers a sensor switch that signals control assembly 17 to activate mechanical insertion and retraction assembly 14. In one embodiment, the activator of the mechanical insertion and retraction assembly 14 includes at least one air cylinder 75 mounted on each side of the mechanical door leaf frame 13. Air cylinders 75 receive air from air regulator 18, through connected internal conduits tubing, when activated by PLC 17B based on the entry of commands by an operator to the PLC 17B. Commands to PLC 17B are preferably provided by wireless communications from an operator, but other forms of communication also can be used, including a wired connection. Other types and forms of activators can be used in other embodiments.

Figure 5:
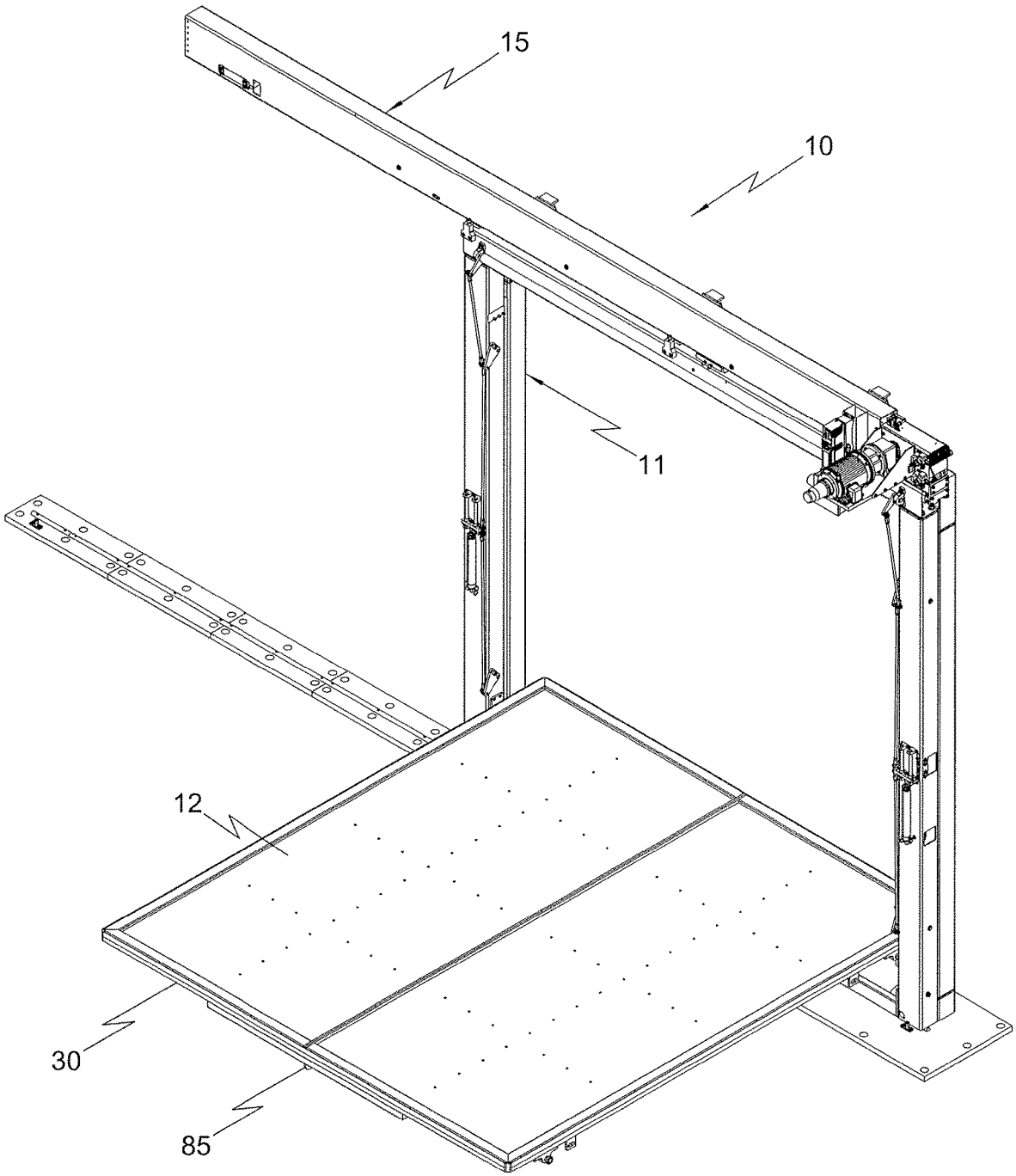
FIG. 5 is a perspective view of the present invention showing the manner in which the RF shielding door leaf can be rotated inward for maintenance and/or replacement of inflatable RF seals.
Figure 6:
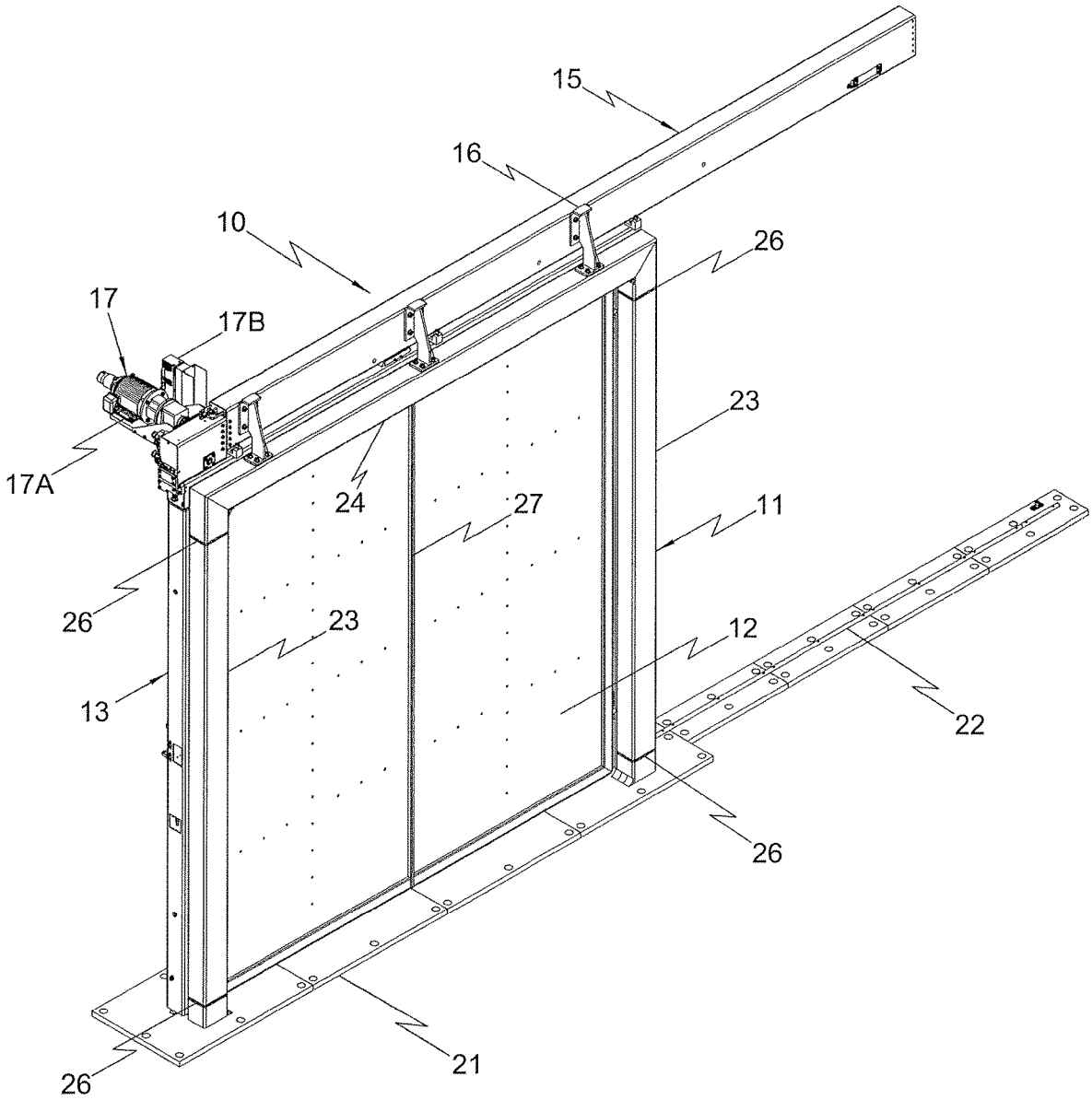
FIG. 6 is a rear left perspective view of the door assembly shown in FIG. 1.
Figure 7:
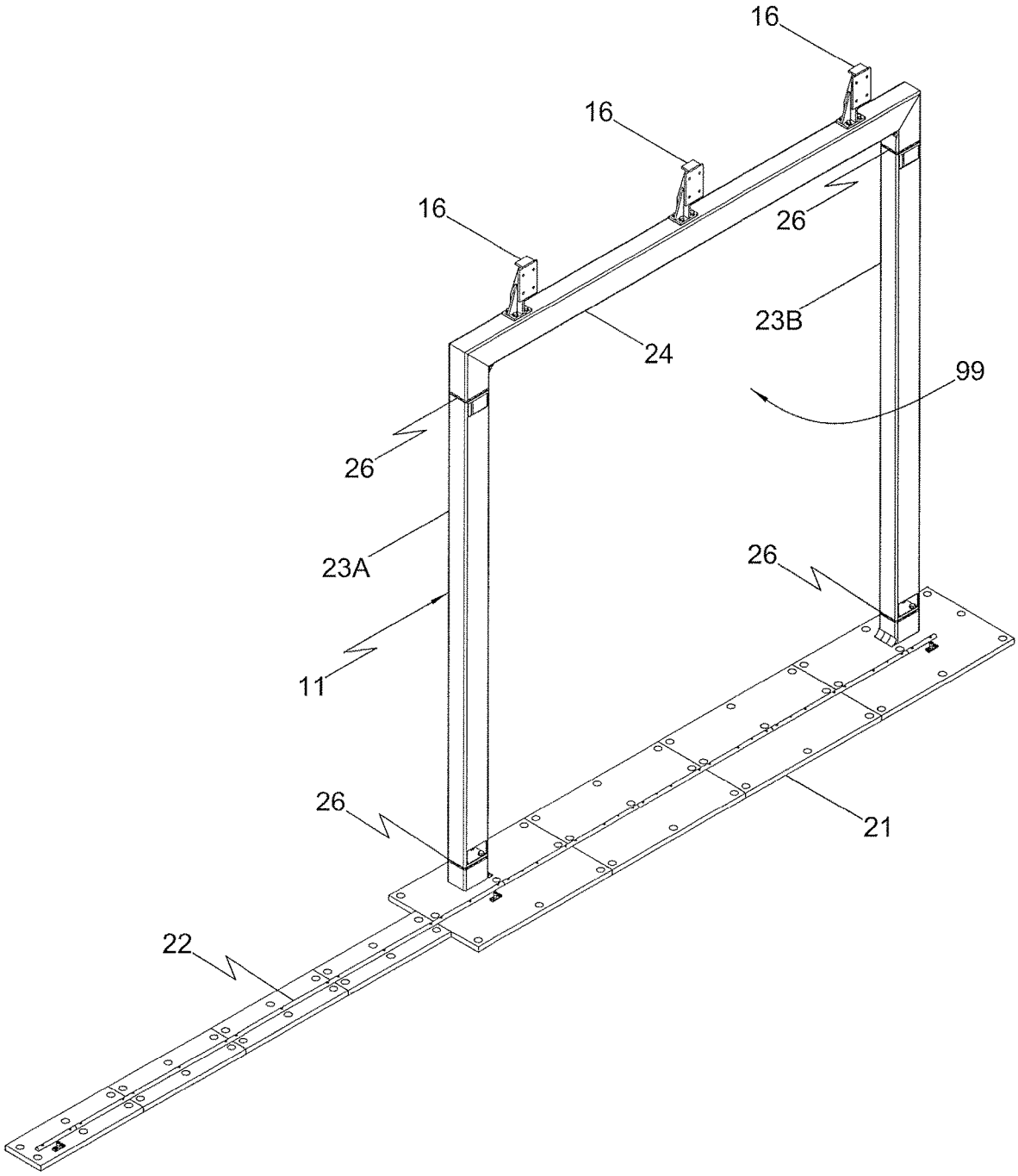
FIG. 7 is a front left perspective view of the RF shielding door frame component and threshold of the door assembly shown in FIG. 1.
Figure 11:
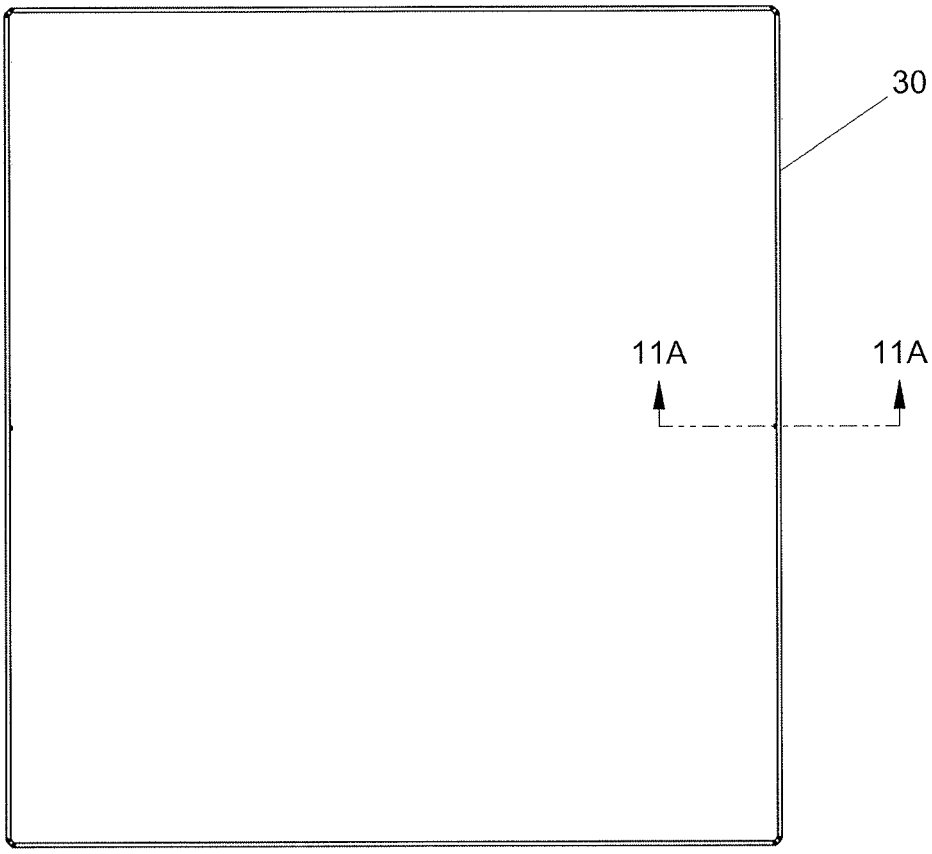
FIG. 11 is a front view of the air seal surrounding the RF shielding door leaf shown in FIG. 10.
Figure 11A:
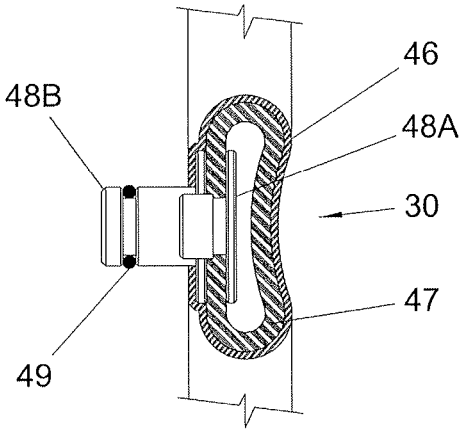
FIG. 11A is a side sectional view of the air seal shown in FIG. 11.

Referring to FIG. 11, at least one HEMP air inflatable seal 30 is installed around the perimeter of the RF shielding door leaf 12, and seal 30 automatically inflates to create a HEMP shielding seal after the RF shielding door leaf 12 is fully inserted into the RF shielding door frame 11. Air regulator assembly 18 is used to both inflate air seals 30 and operate air cylinders 75, through connective internal conduits and tubing, and air regulator assembly 18 is automatically triggered to inflate air seals 30 by a sensor switch that signals control assembly 17 and air regulator assembly 18 when RF shielding door leaf 12 is fully inserted into the RF shielding door frame 11. In one embodiment, two side-by-side HEMP air inflatable seals 30 are installed around the perimeter of the RF shielding door leaf 12 to create the HEMP seal when the RF shielding door leaf 12 is inserted into the RF shielding door frame 11. In other embodiments, three or more inflatable seals 30 can be used. Referring to FIG. 11A, seal 30, at a point of connection to an air supply at the perimeter of RF shielding door leaf 12 includes gasket 46, bladder 47, O ring bladder stem (female) 48A, O ring bladder stem (male) 48B and O ring 49. O ring bladder stem (male) 48B extends from the perimeter of RF shielding door leaf 12. In one embodiment, at least one air supply connection is located on opposite side ends of RF shielding door leaf 12. FIG. 5 illustrates the location of double air seals 30 on the perimeter of the RF shielding door leaf 12.

Figure 10:
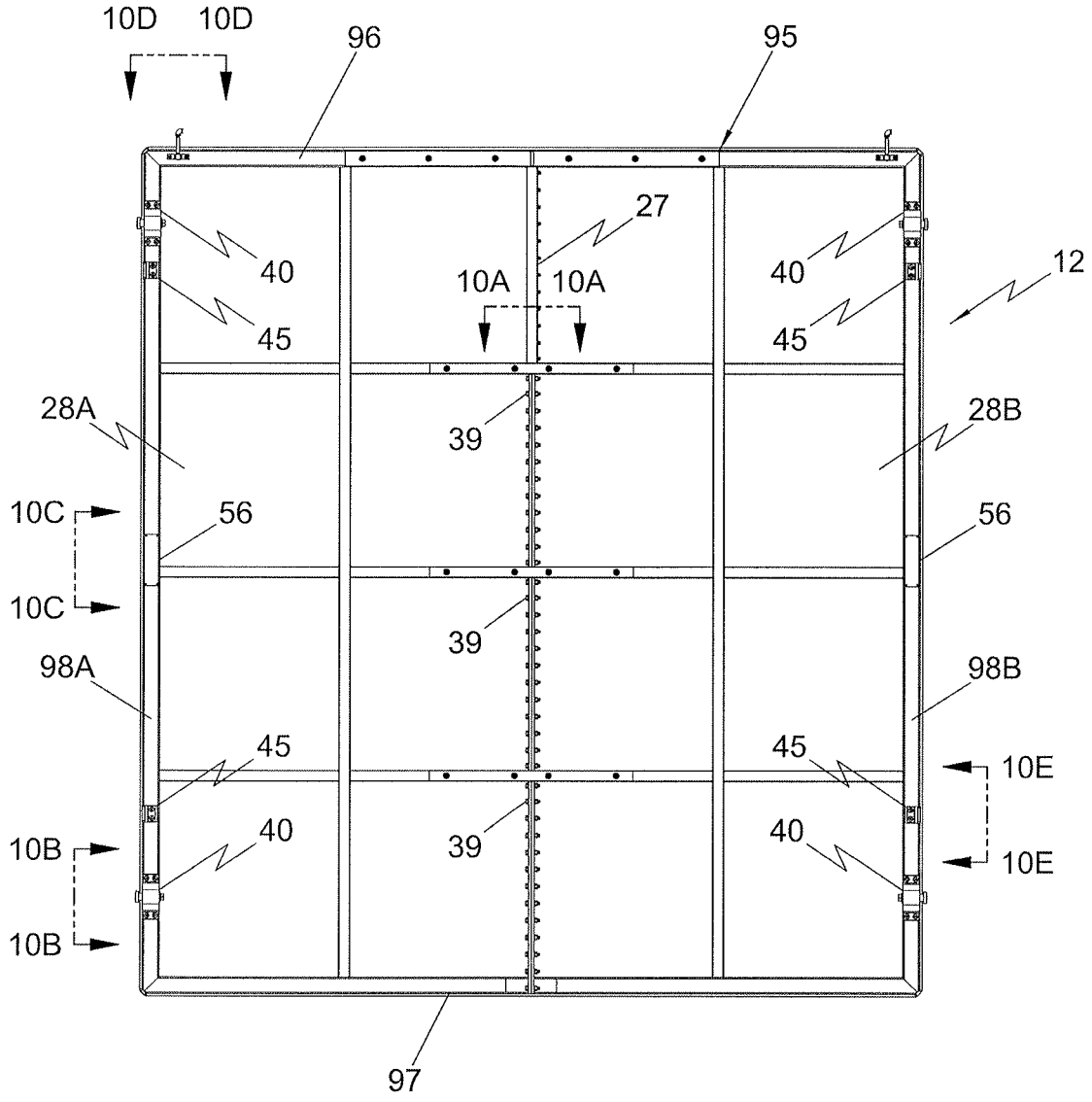
FIG. 10 is a front view of the RF shielding door leaf component of the RF sliding door shown in FIG. 1.
Figure 10A:
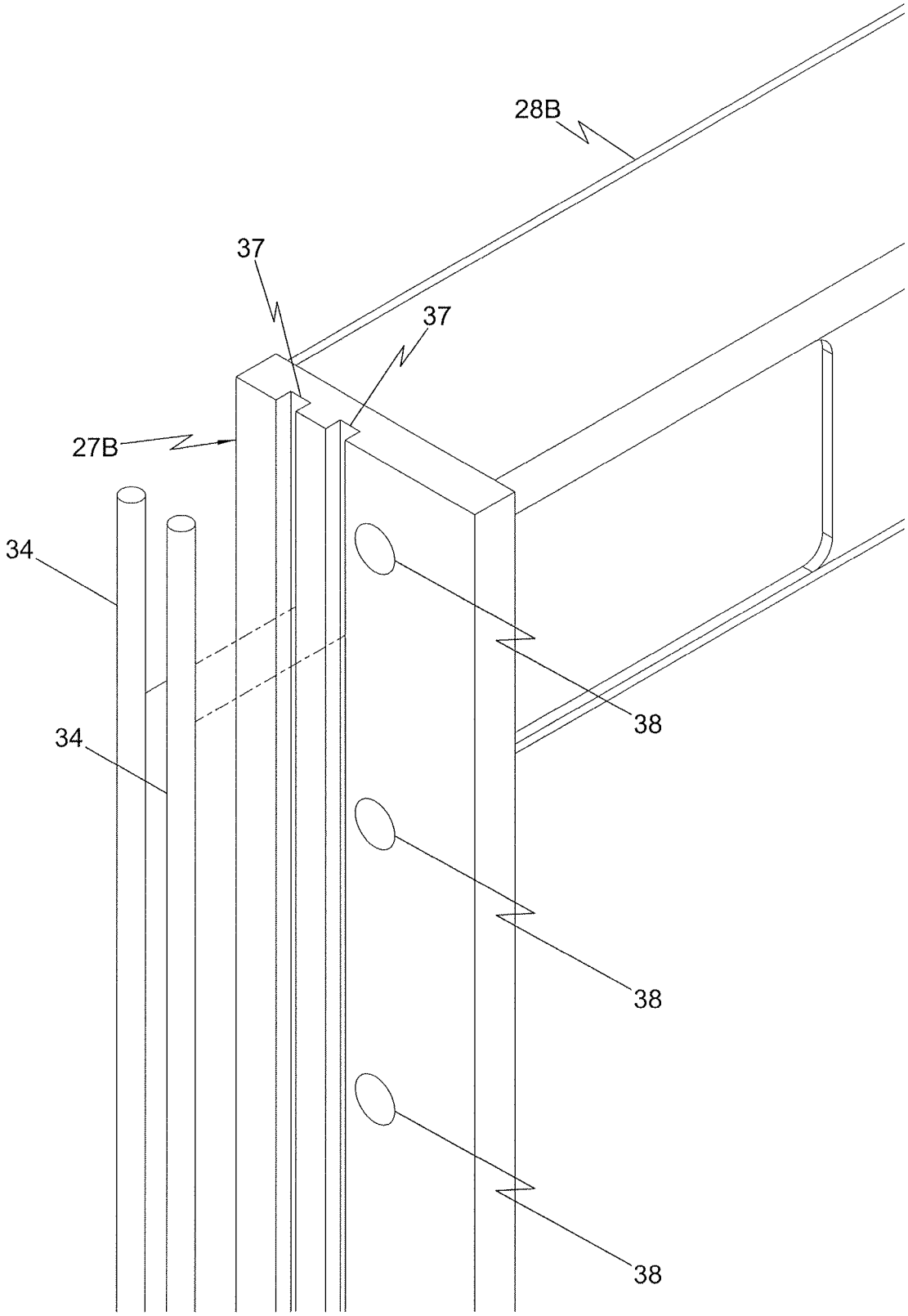
FIG. 10A is a perspective cut-out view of one edge of the leaf joint in the RF shielding door leaf component shown in FIG. 10.
Figure 10B:
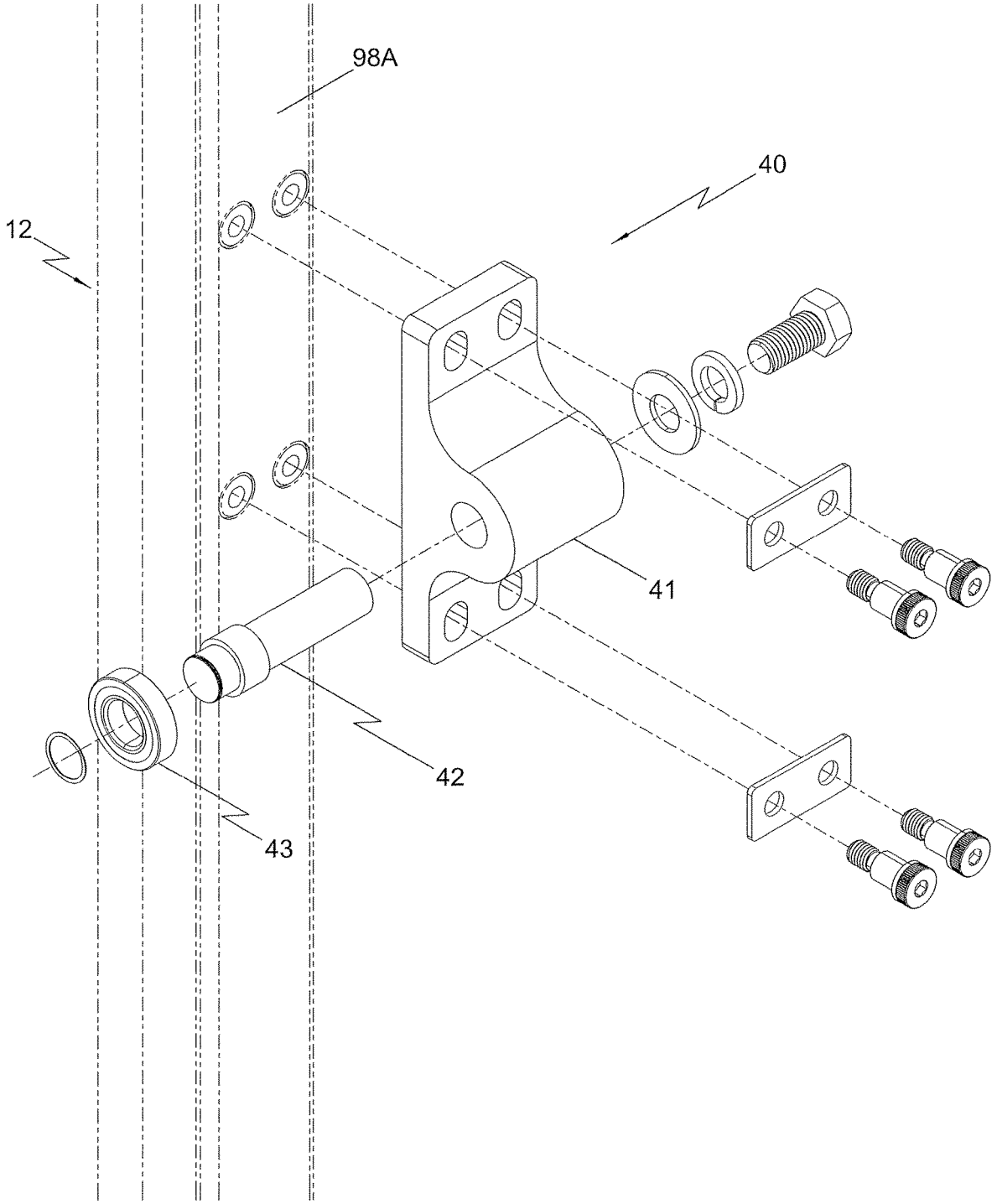
FIG. 10B is a perspective sectional telescoping view of the RF track roller body shown in FIG. 10.
Figure 10C:
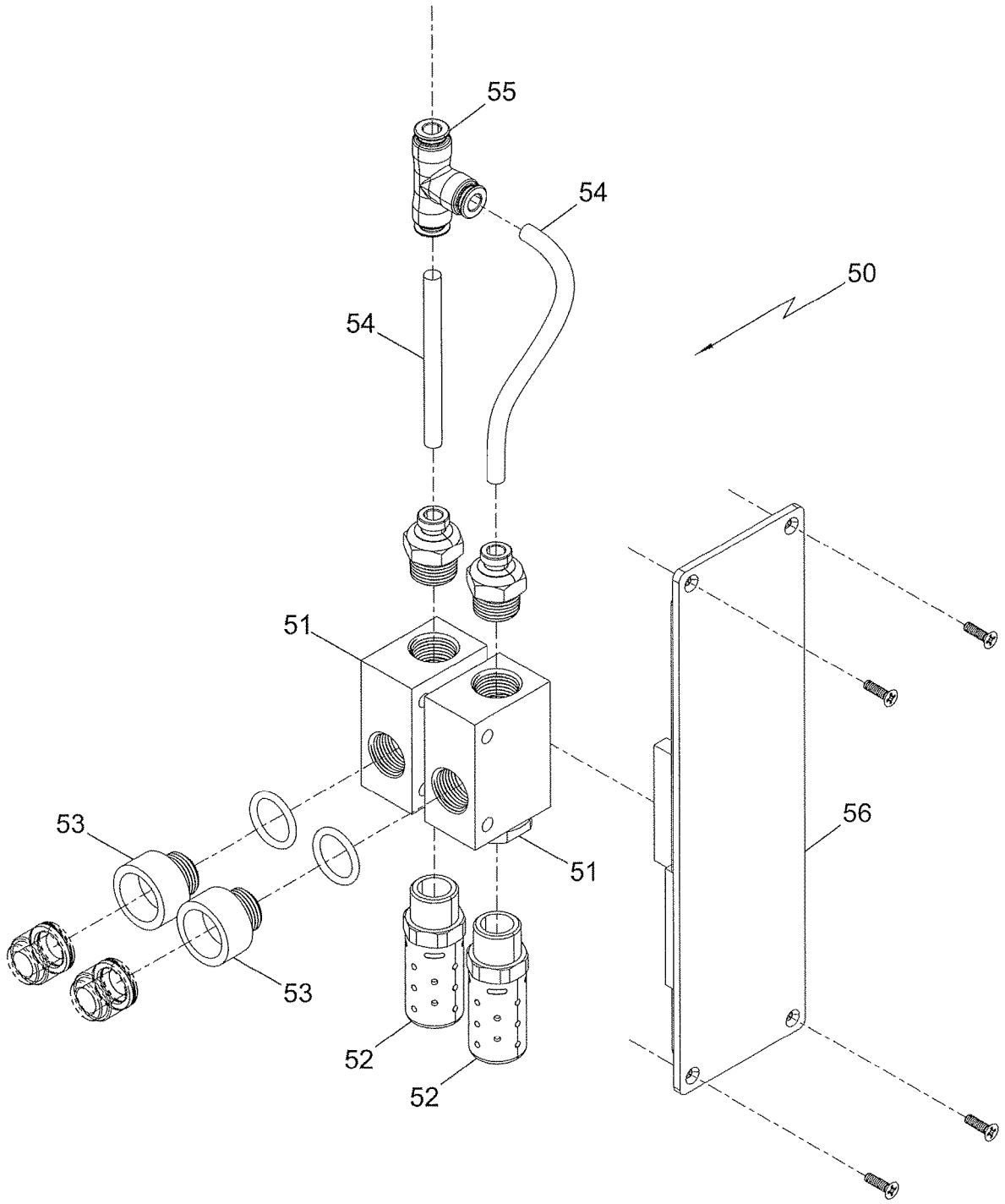
FIG. 10C is a perspective sectional telescoping view of a quick exhaust assembly shown in FIG. 10.

In one embodiment, and with reference to FIG. 10C, the sliding door assembly 10 of the present invention includes an air exhaust assembly 50 that acts to deflate HEMP seals 30 if a retraction process is activated by an operator or if power is lost. If an operator activates a retraction process, the control assembly 17 activates the air exhaust assembly 50, resulting in deflation of HEMP seals 30. Upon deflation of HEMP seals 30, RF shielding door leaf 12 automatically retracts from the RF shielding door frame 11, and, upon, full retraction, mechanical door leaf frame 13, along with RF shielding door leaf 12, are moved to an open position. In the event of a power loss, the RF shielding door leaf 12 also automatically retracts from the RF shielding door frame 11, and the RF shielding door leaf 12 and mechanical door leaf frame 13 can be manually slid to an open position.

Referring to FIGS. 7, 8, 8A and 9, the RF shielding door frame 11 is preferably made of 304 Stainless steel square or rectangular tube, although comparable materials also can be used. The size and wall thickness of the RF shielding door frame 11 is dependent on the clear opening of the RF shielding door frame 11. The RF shielding door frame 11 includes side jams 23A and 23B and a head 24 and is mounted on an RF shielding bottom component or threshold 21 with a central longitudinal rail 22.

The RF shielding threshold 21 of the RF shielding door frame 11 preferably is made from 304 stainless steel plate as well, although comparable materials again can be used. The plate is nominally 1½" thick but varies based upon the size of the RF shielding door frame 11 and the loads to be transported across it. As shown further in FIG. 9, the threshold 21 can have holes 25 for installing masonry anchors which are recessed and which each have provisions for a cap which is welded in place to maintain the HEMP shielding. In another embodiment, a rectangular or square stainless steel tube can be substituted for the stainless steel floor plate can be substituted for threshold 21 based upon construction requirements.

In one embodiment, the rail 22 of the RF shielding door frame threshold 21 is machined from 1¼" 304 stainless steel rod. Further, the threshold rail 22 can be manufactured in sections which are removable should one or more become damaged.

Figure 8A:
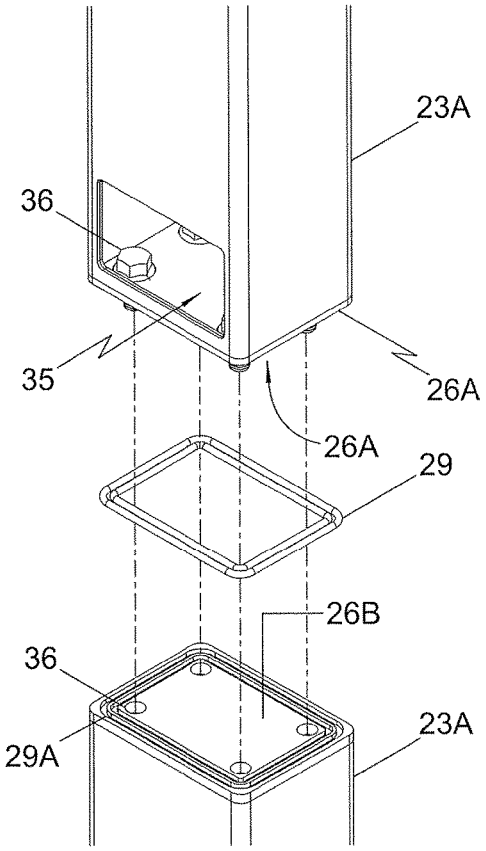
FIG. 8A is a perspective sectional telescoping view of the RF shielding door frame joint of the RF shielding door frame component shown in FIG. 8.
Figure 8:
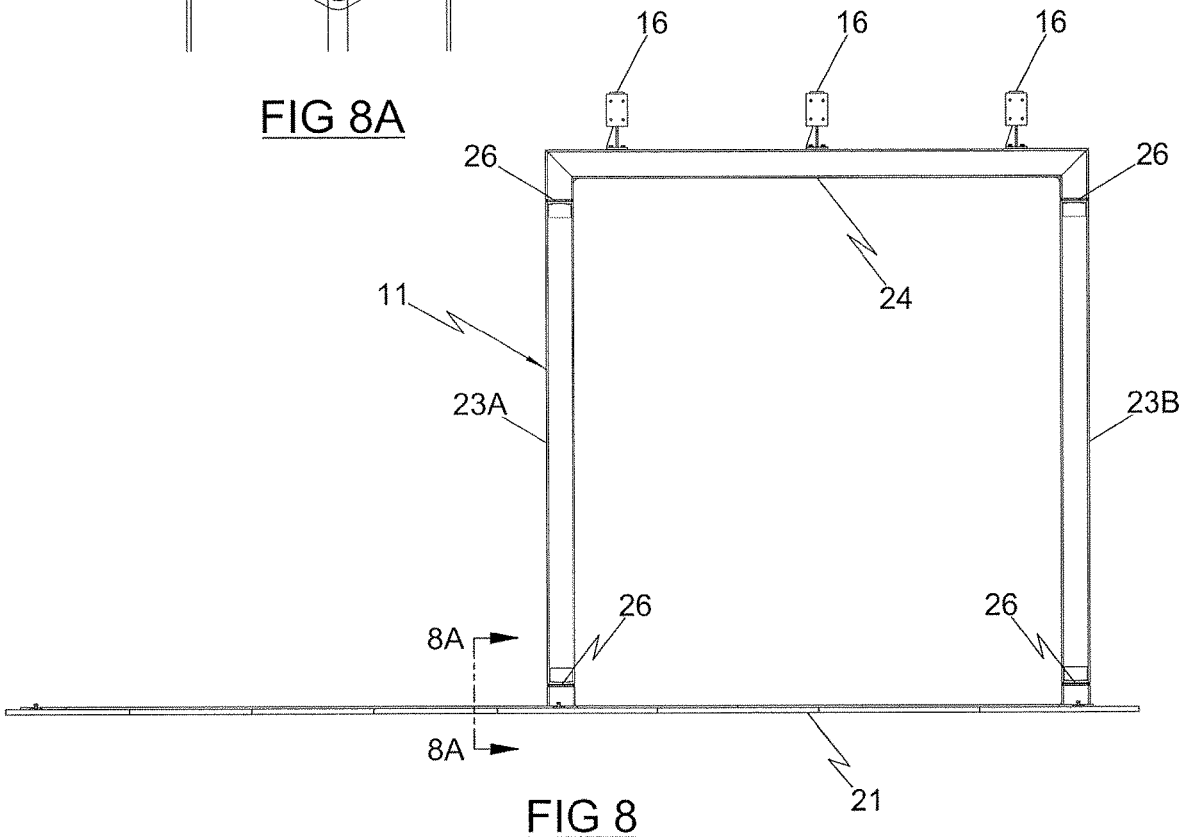
FIG. 8 is a front view of the RF shielding door frame component and threshold or floor plate of the door assembly shown in FIG. 1.
Figure 9:
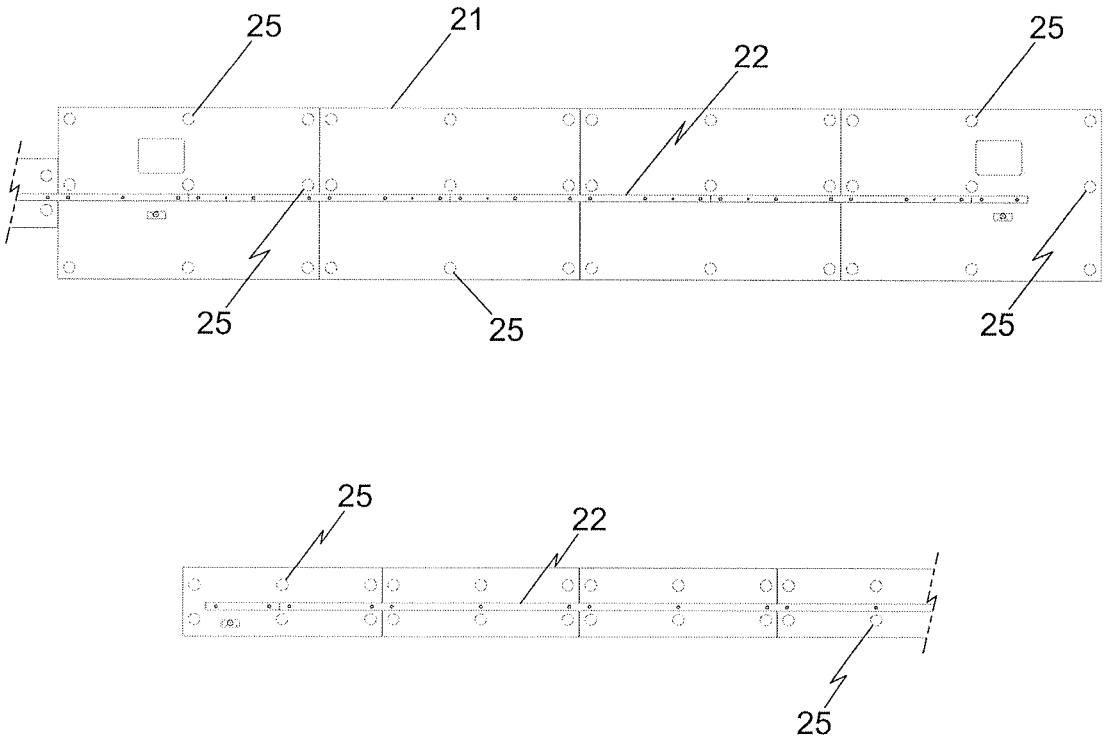
FIG. 9 is a top view of the threshold of the door assembly shown in FIG. 1.

The RF shielding door frame 11 is either fully welded at the factory or, when too large to be shipped commercially, is manufactured in multiple pieces for assembly in the field with RF tight joints 26 that are machined and gasketed. The joinder of pieces of RF shielding door frame 11 at a joint 26 is shown in FIG. 8A. Joint 26 is formed by the joinder of closed bottom end 26A of upper RF shielding side door frame member 23A and the closed upper end 26B of lower RF shielding side door frame member 23A. A gasket 29 is inserted in a gasket receptacle 29A around the perimeter of the closed upper end 26B of lower frame member 23A (the corresponding closed bottom end 26A also has a gasket receptacle. RF shielding side door frame member 23A has an opening 35 that permits an installer to insert bolts or screws 36 into openings 36 in closed bottom end 26B and closed upper end 26A so as to firmly attach upper side door frame member 23A to lower frame member 23A.

Referring to FIGS. 10, 10A, 10B, 10C, 10D, 10E, 11 and 11A, RF shielding door leaf 12 has an outer frame 95, with top frame member 96, bottom frame member 97 and side frame members 98A and 98B, together with internal leaf sections (shown as sections 28A and 28B in FIG. 10). RF shielding door leaf 12 can be made in one fully welded piece or multiple sections for assembly in the field with RF tight joints 27 when too large to be shipped commercially. FIG. 10 illustrates two RF shielding door leaf sections 28A and 28B (left and right panels, respectively). In other embodiments, more than two leaf sections can be used. As shown in FIG. 10A, inside edge 27B of RF shielding door leaf section 28B has gasket receptacles 37 for placement of gaskets 34 in forming joint 27 and holes 38 for use in attaching RF shielding door leaf sections 28A and 28B together (the inside edge of RF shielding door leaf section 28A has corresponding gasket receptacles 37 and insert holes 38. An RF shielding tight joint 27 is created by use of bolts 39 in insert holes 38.

The perimeter of the RF shielding door leaf 12 preferably is made from 3" square stainless steel tube or larger when required by door size. Again, other comparable materials can be used. When made in sections for shipping purposes, the adjoining edges preferably are made from 304 stainless steel bar (or other comparable materials), which, as discussed above, are machined and gasketed to create a HEMP seal when bolted together.

Preferably, ⅛" steel plate is fully welded into the frames 28 of the RF shielding door leaf 12; however thinner or thicker steel may be used based upon the customer's desired level of magnetic shielding performance above specified minimums.

Figure 14:
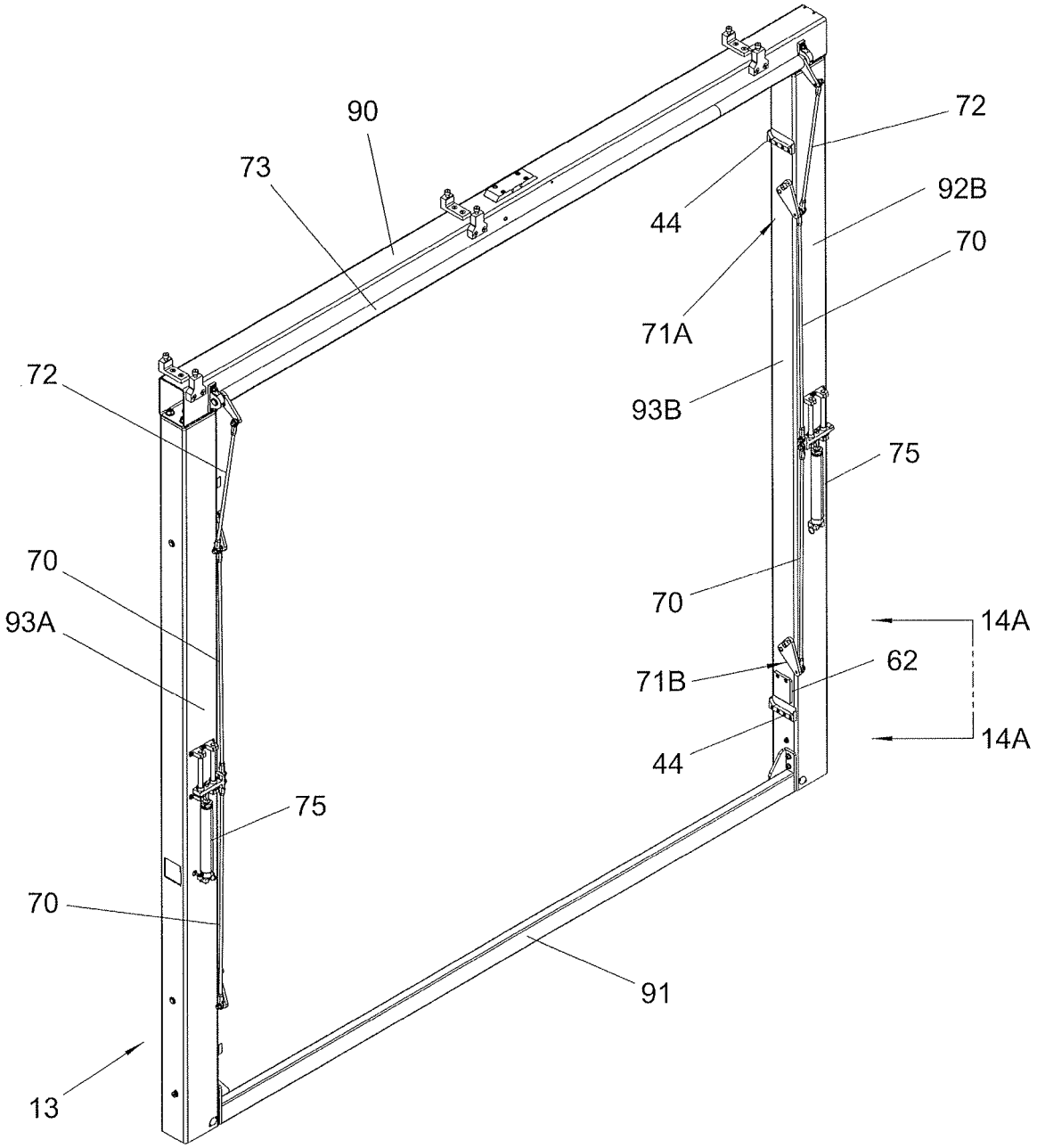
FIG. 14 is a front left perspective view of the mechanical door leaf frame and the mechanical insertion and retraction assembly of the door assembly shown in FIG. 1.
Figure 14A:
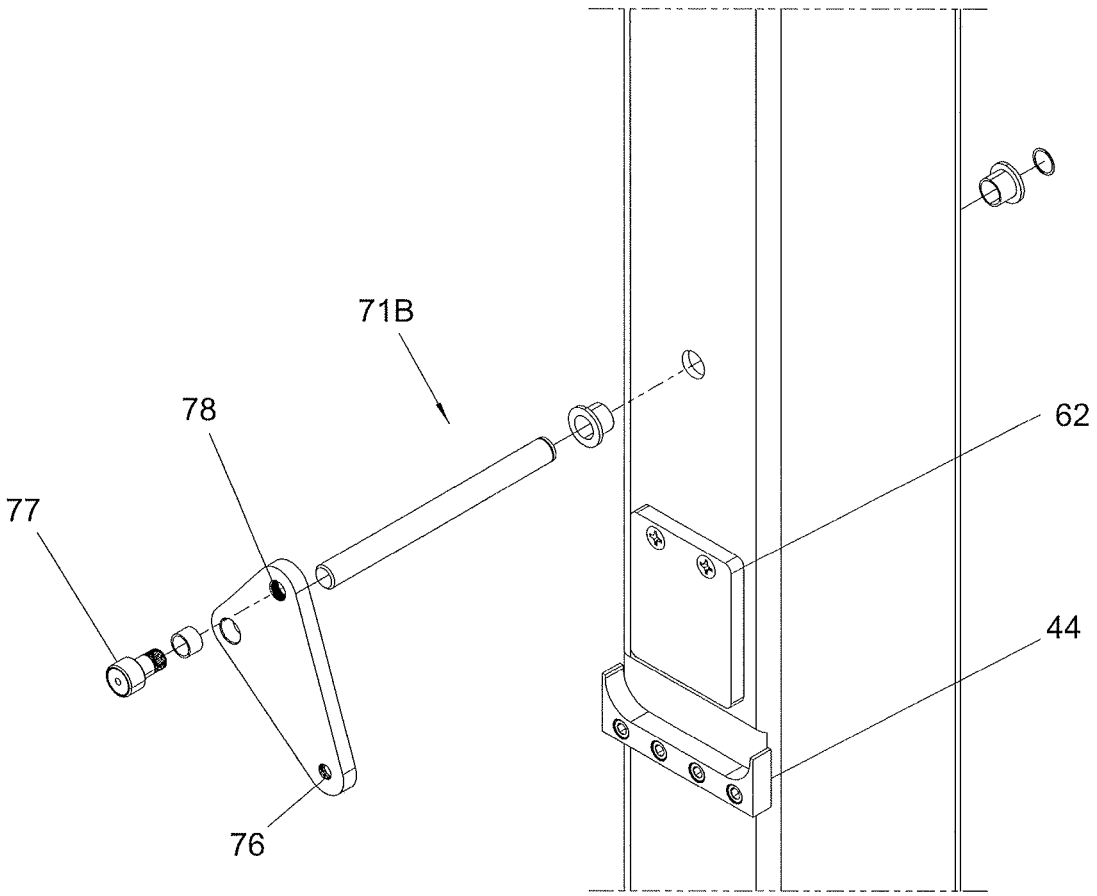
FIG. 14A is a perspective sectional telescoping view of the cam roller assembly of the mechanical insertion and retraction assembly shown in FIG. 14.

FIG. 10B illustrates an RF track roller ball assembly 40, which includes RF track roller ball housing 41, bearing shaft 42, and ball bearing 43. Referring also to FIGS. 10 and 14, two RF track roller ball assemblies 40 are mounted to side frame member 98B of RF shielding door leaf 12 (shown in FIG. 10) and interact with and rest in two corresponding track roller sleeves 44 that are mounted on the side frame member 93B of mechanical door leaf frame 13 (shown in FIG. 14). The same configuration of RF track roller ball assemblies 40 and corresponding track roller sleeves 44 are mounted on side frame member 98A of shielding door leaf 12 and side frame member 93A of mechanical door leaf frame 13. RF track roller ball assemblies 40 and corresponding track roller sleeves 44 operate to support RF shielding door leaf 12 in mechanical door leaf frame 13. In other embodiments, more than two track roller ball assemblies 40 and corresponding track roller sleeves 44 can be used. As shown in FIGS. 14 and 14A, lower track roller sleeve 44 also has a plate 62 attached above roller sleeve 44. As discussed further below, plate 62 helps hold roller ball assemblies 40 into the lower track roller sleeves 44 when shielding door leaf 12 is pivoted inward for maintenance.

The air exhaust assembly 50 in one embodiment of the present invention is shown in FIG. 10C. As discussed above, the air exhaust assembly 50 operates to release air from seal 30 in the event of a retraction activation or a power loss. Air exhaust assembly is located within shielding door leaf 12 and includes quick exhaust valves 51, mufflers 52, dump valve adaptors 53, tubing 54 that connects via fitting 55 to tubing located inside shielding door leaf 12. In one embodiment, this tubing is copper tubing. Air exhaust assembly is located behind air exhaust panel 56, which mounts to shielding door leaf 12. In operation, air valves in air regulator assembly 18 are wired as "Normally Closed" so that when power is lost, a spring closes the valves and exhausts the remaining air pressure in the downstream lines. The reduced seal line pressure activates the quick exhaust valves 51, and a spring inside air cylinder 75, together with gravity (as described below), retracts the RF shielding door leaf 12.

Figure 10D:
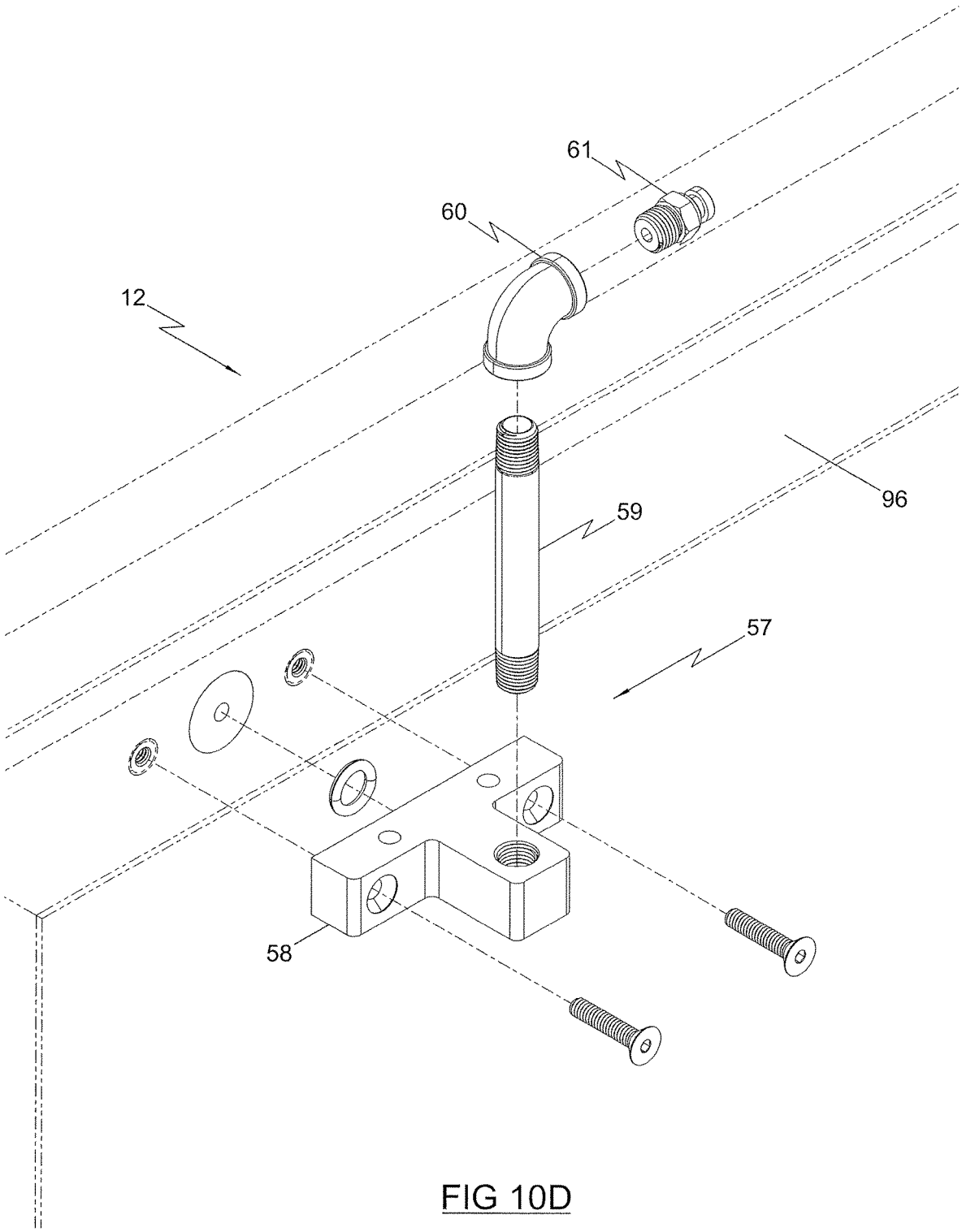
FIG. 10D is a perspective sectional telescoping view of an air conduit assembly shown in FIG. 10.

FIG. 10D illustrates a nipple assembly 57 that mounts to the exterior of RF shielding door leaf 12. Once RF shielding door leaf 12 is fully inserted into RF shielding door frame 11, air for inflating seal 30 flows from nipple 59 into air transfer 58 and, from there, to copper tubing located within RF shielding door leaf 12. Nipple 59 is connected to fittings 60 and 61, which serve as a receiving connection for air generated from air regulator assembly 18, which passes by internal conduits and tubing.

Figure 10E:
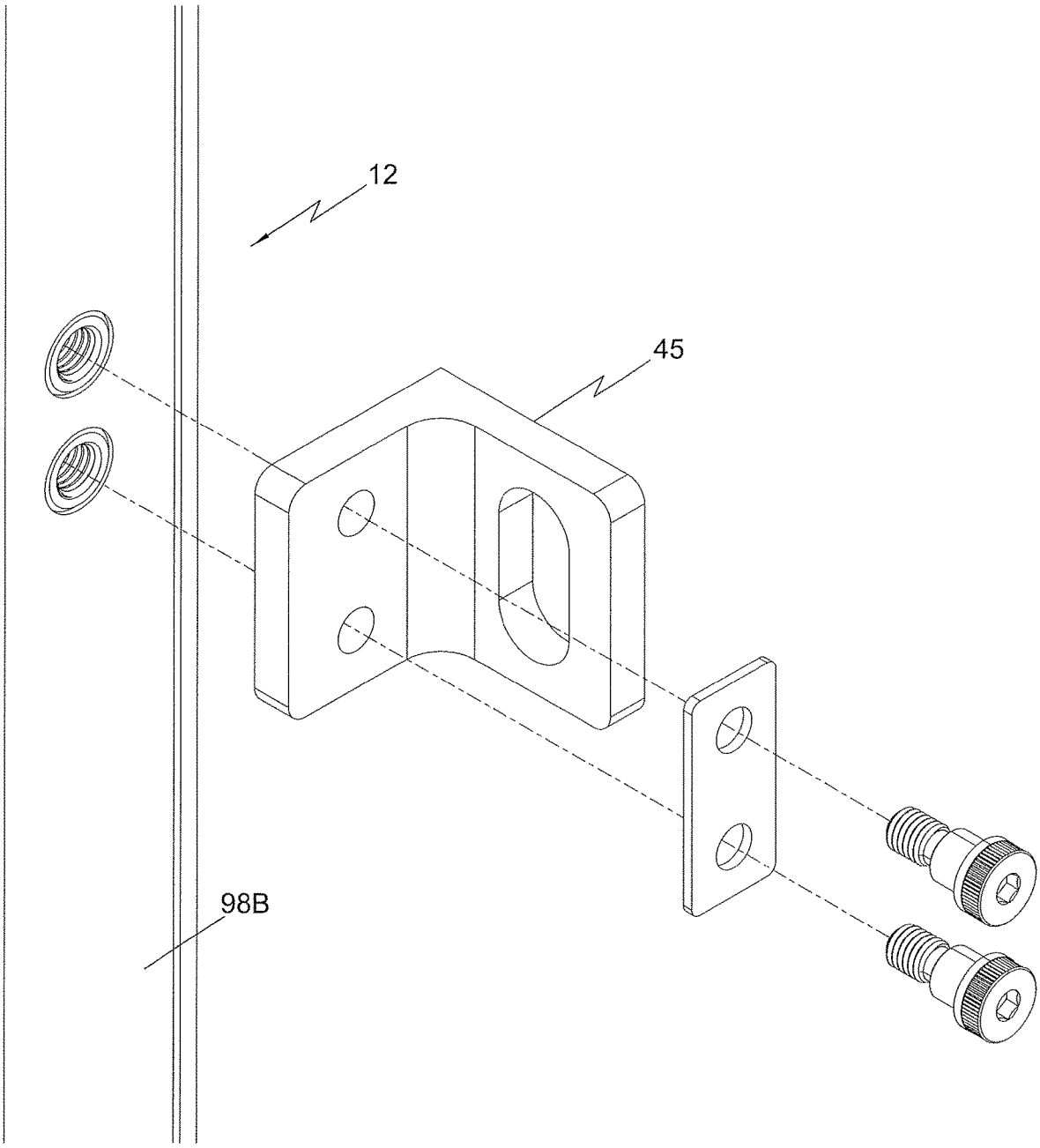
FIG. 10E is a perspective sectional telescoping view of a cam bracket as shown in FIG. 10.

FIG. 10E illustrates bracket 45 which, as discussed below, interacts with track roller 77 in cam rollers 71A and 71B in order to aid in the insertion of RF shielding door leaf 12 into RF shielding door frame 11.

Mechanical door leaf frame 13 and mechanical insertion and retraction assembly 14 are shown in FIGS. 2, 13, 13A, 13B, 13C, 14 and 14A. As discussed above, the RF shielding door leaf 12 is mounted on and carried by a mechanical door leaf frame 13 located around the perimeter of the RF shielding door leaf 12. Mechanical door leaf frame includes top frame member 90, bottom frame member 91, and side frame members 92A and 92B. Side frame members 92A and 92B each have inner sides 93A and 93B. The mechanical door leaf frame 13 preferably is either made in one fully welded piece or, when too large to be shipped commercially, multiple sections for assembly in the field.

Figure 12:
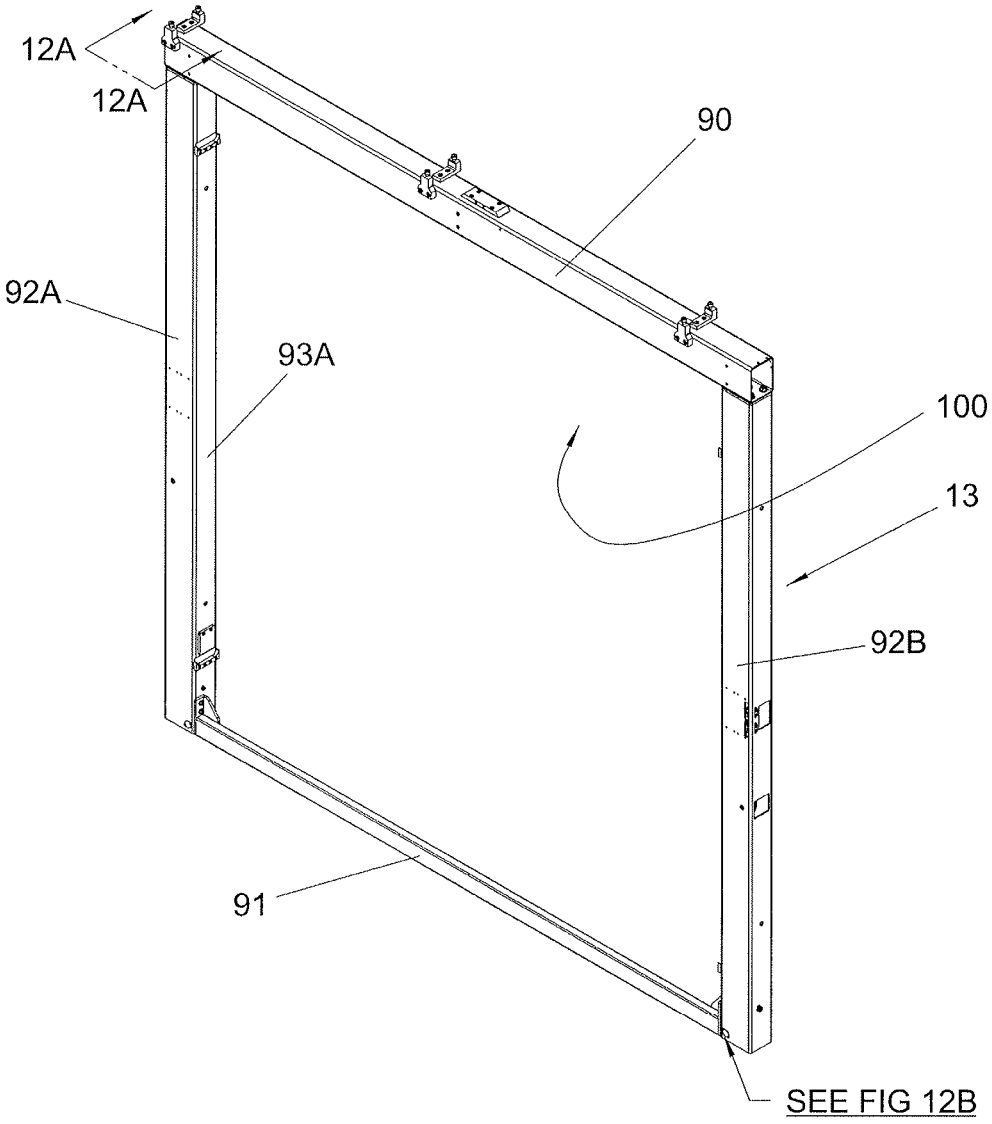
FIG. 12 is a front right perspective view of the mechanical door leaf frame of the door assembly shown in FIG. 1.
Figure 12A:
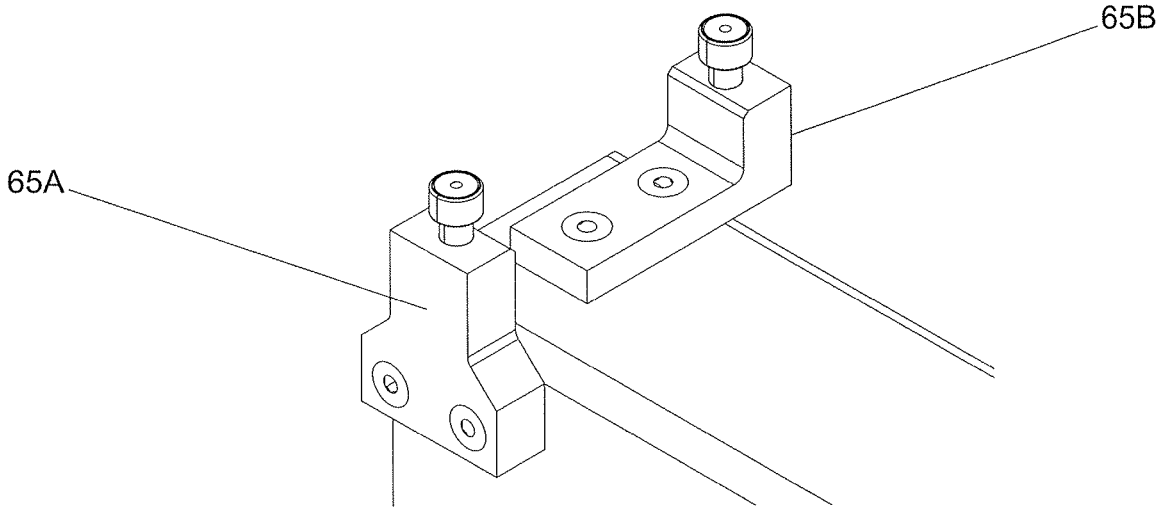
FIG. 12A is a perspective sectional view of the sliding guide assembly of the mechanical door leaf frame shown in FIG. 12.
Figure 12B:
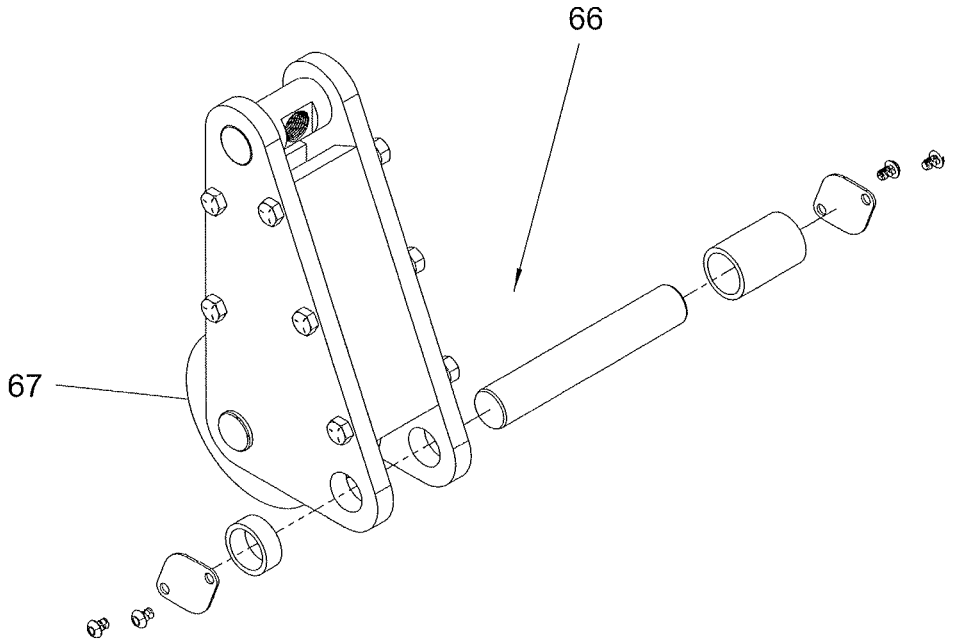
FIG. 12B is a perspective sectional view of one wheel assembly of the mechanical door leaf frame shown in FIG. 12.

Referring to FIGS. 12 and 12A, a plurality of paired slider guides 65A and 65B are mounted on the top of mechanical door leaf frame 13. Sliders 65A and 65B interact with drive tube assembly 15 and act to guide the top of mechanical door leaf frame 13 as it slides to open and closed positions. Referring to FIGS. 12 and 12B, at least two wheel assemblies 66 are mounted within at least the lower corners of mechanical door leaf frame 13. Additional wheel assemblies can be used. Wheel assembly 66 can have "V" grooved steel wheels 67 that rest over and roll along rail 22 to assist in sliding door to open and closed positions. In other embodiments, the sliding motion of mechanical door leaf frame 13 can be aided by other components and/or mechanisms.

Figure 13:
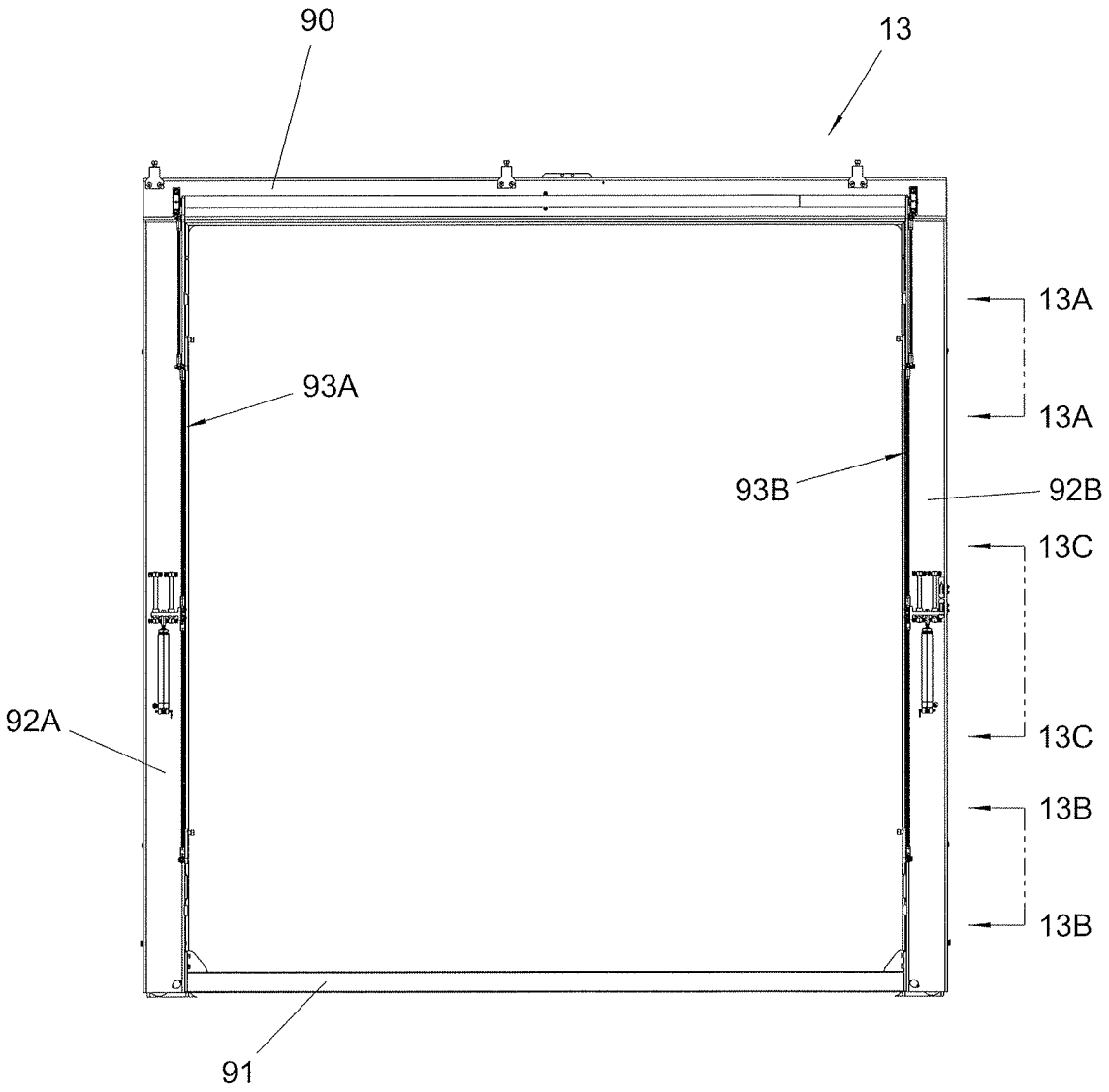
FIG. 13 is a front view of the mechanical door leaf frame of the door assembly shown in FIG. 1.
Figure 13A:
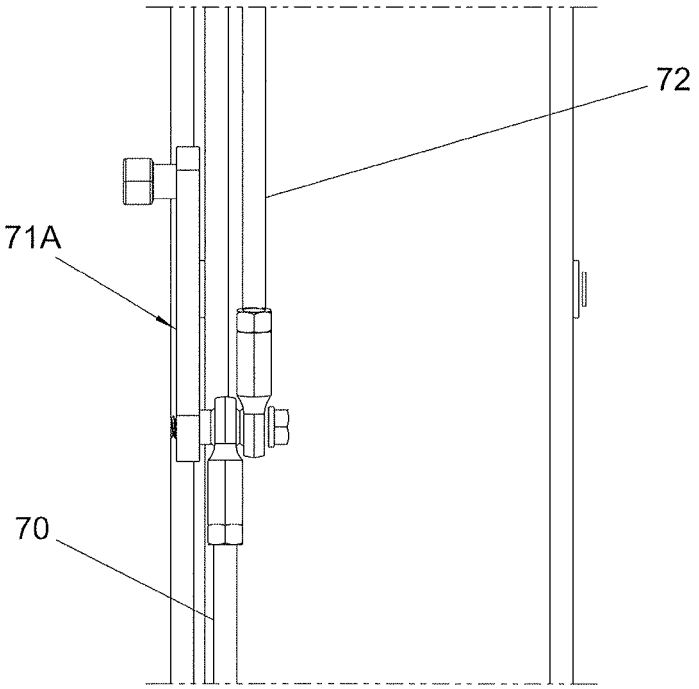
FIG. 13A is a front sectional view of the upper cam roller assembly of the mechanical door leaf frame shown in FIG. 13.
Figure 13B:
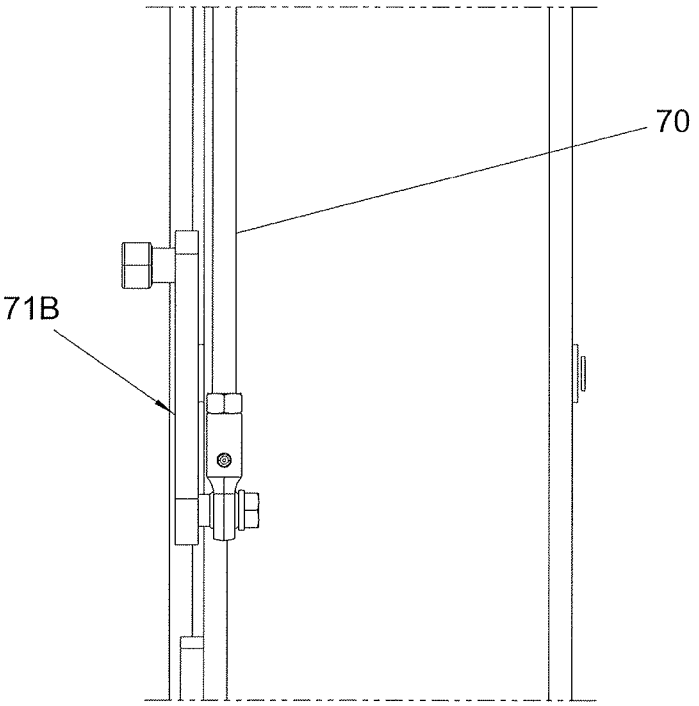
FIG. 13B is front sectional view of the lower cam roller assembly of the mechanical door leaf frame shown in FIG. 13.
Figure 13C:
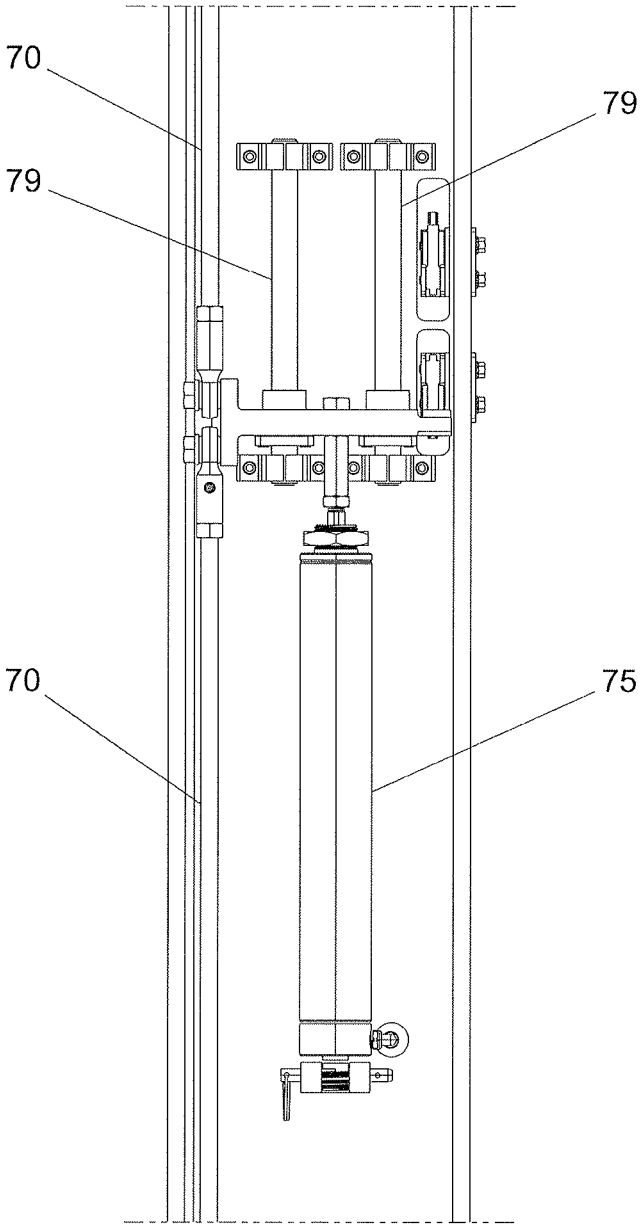
FIG. 13C is a side sectional view of the air cylinder assembly of the mechanical door leaf frame shown in FIG. 13.

The mechanical door leaf frame 13 houses two mechanical insertion and retraction assemblies 14 which extend and retract the RF shielding door leaf 12 into and out of the RF shielding door frame 11—a direction generally perpendicular to the plane in which the sliding mechanical door leaf frame 13 moves. Referring to FIGS. 2, 13, 13A-13C, 14 and 14A, each of the two mechanical insertion and retraction assemblies 14 are mounted on side frame members 92A and 92B, and, in one embodiment, each includes an air cylinder 75 that is connected to and interacts with rods 70 that in turn, are connected to upper and lower cam roller assemblies 71A and 71B, respectively. Upper cam roller assembly 71A is connected by rod 72 to a torque tube 73. FIGS. 13A, 13B, and 13C show cam rollers 71A and 71B and air cylinder 75 located on one side frame member 92B of mechanical door leaf frame 13 (mirror images of rollers 71A and 71B and air cylinder 75 also are located on side member 92A). Referring to FIG. 14A, cam roller 71B pivotably connects to mechanical door leaf frame 13. Cam roller 71B also pivotably connects at insert hole 76 to rod 70, and cam roller 71B further includes a track roller 77 that connects to insert hole 78. Track roller 77 slidably engages with cam bracket 45, and cam bracket 45 is mounted on RF shielding door leaf 12. In other embodiments, insertion and retraction assembly 14 can operate by other components and/or mechanisms that function to provide the same motion for RF shielding door leaf 12.

In operation, and in one embodiment, air cylinders 75 are activated by PLC 17B based on the entry of commands by an operator to the PLC 17B, and air regulator assembly 18 provides pressured air to air cylinders 75. Upon activation, air cylinders 75 push upward on linear motion shafts 79, and this motion, in turn, acts to push rods 70 upward. The upward motion of rods 70, in turn, causes cam rollers 71A and 71B to pivot upward, whereby the interaction between track roller 77 within cam bracket 45 pushes the RF shielding door leaf 12 into the RF shielding door frame 11. This inward movement is facilitated by the rolling interaction of RF track roller ball assembly 40 and track roller sleeve 44 (see also FIG. 14A). In connection with rods 72, torque tube 73 operates to balance the movement of both mechanical insertion and retraction assemblies 14. In particular, torque tube 73 and rods 72 help to even the movement resulting from activation of air cylinders 75 in the event that there is an air pressure differential between air cylinders 75.

In one embodiment, when the air pressure for air cylinders 75 is removed, a mechanical return, including, for example, a spring, in the mechanical insertion and retraction assemblies 14, together with gravity, automatically retracts the RF shielding door leaf 12 from the RF shielding door frame 11. In particular, once air pressure to air cylinders 75 is removed, cam roller assemblies 71A and 71B, together with rods 70 and 72, move downward by their own weight. This downward movement, in turn, disengages the inward push on RF shielding door 12 by interaction of track roller 77 within cam bracket 45 and, thereby, retracts RF shielding door 12. In a preferred embodiment, the mechanical assembly 14 further incorporates indicating switches to tell motor controller/PLC 17B associated with motor 17A when the RF shielding door leaf 12 is fully extended or retracted.

Referring to FIGS. 15, 15A, 15B, 15C, 16 and 16A, the control assembly 17 includes a motor 17A, a motor drive/PLC 17B and air regulator assembly 18. The drive tube assembly 15A includes a drive frame tube 80, a timing belt 81, a timing belt tensioner 82, and a timing belt coupler 83. Timing belt 81 engages with a rotary drive wheel 84 connected to motor 17A. Timing belt coupler 83 connects to the top of mechanical door leaf frame 13. The motor 17A, when commanded to do so by motor drive/PLC 17B, causes timing belt 81 to move and thereby slides mechanical door leaf frame 13, along with RF shielding door leaf 12, between open and closed positions. The operator assembly 15 can employ an induction, stepper or synchronous motor 17A, depending upon the size and weight of the mechanical door leaf frame 13 and the associated RF shielding door leaf 12 and an absolute encoder for position accuracy. Over-run limit switches are used to immediately stop the motor 17 should the open position of the mechanical door leaf frame 13 be programmed too far in distance. In one embodiment, timing belt 80 is a Kevlar reinforced urethane timing belt 19 properly sized for the weight of RF shielding door leaf 12 and mechanical door leaf frame 13.

In one embodiment, the motor drive/PLC 17B monitors and controls the following functions:

a) Operator inputs through use of a controller for controlling operation of sliding door assembly 10, with such inputs including: OPEN, CLOSE, STOP;
b) The position of mechanical door leaf frame 13, along with RF shielding door leaf 12;
c) Acceleration, max speed and deceleration of the movement of mechanical door leaf frame 13, along with RF shielding door leaf 12;
d) Air pressure for the air seals 30;
e) Air pressure for the air cylinders 75;
f) Communication to external devices through Ethernet or wireless communications via ModBus of HTTP (or other comparable communications protocols);
g) Modification of program variables can be modified at the motor drive/PLC 17B through a non-volatile memory card or remotely with an Ethernet or wireless connection;
h) Motor current limiting for personnel safety;
i) Alarm functions; and
j) Remote operation.

Figure 16A:
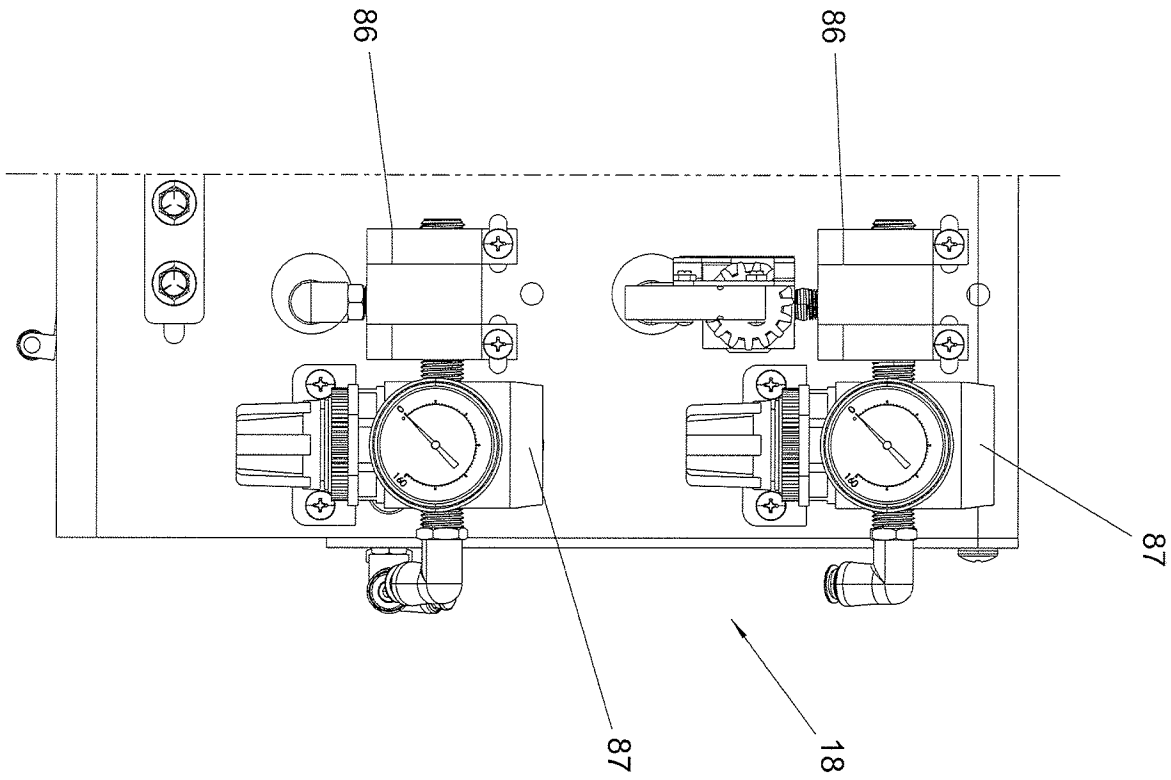
FIG. 16A is a detailed front view of the air regulator shown in FIG. 16

Referring to FIGS. 16 and 16A, the air regulator assembly 18 includes air valves 86 and regulators 87. As discussed above, the air regulator assembly 18, through internal conduits and tubing, provides air to activate air cylinders 75. As discussed above, tubing located within RF shielding door leaf 12 is copper in one embodiment. Tubing located with the frame of mechanical door leaf frame 13 is, in one embodiment, ¼" polyurethane tubing. In particular, once mechanical door leaf frame 13 slides into alignment with RF shielding door frame 11, a conduit is formed for air from the air regulator assembly 18 to enter mechanical door leaf frame 13. At this same point of alignment between mechanical door leaf frame 13 and RF door frame 11, an electrical connection is made between control assembly 17 and mechanical insertion and retraction assemblies 14. The air regulator assembly 18 also inflates air seals 30 through internal conduits and tubing. Further, when RF shielding door leaf 12 is fully inserted into RF shielding door frame 11, nipple assembly 57 allows air from air regulator assembly 18 to enter the top of RF shielding door leaf 12. The air continues to run inside steel and/or copper tubing at the perimeter of the RF shielding door leaf 12 to the air seals 30. A limit switch at the end of the air cylinder 75 stroke signals the motor drive/PLC 17B to inflate the air seals 30.

Referring to FIG. 5, the features and components of the HEMP shielded sliding door 10 of the present invention also allow for easy maintenance or removal/replacement of inflatable RF seals 30. FIG. 5 illustrates that the RF shielding door leaf 12 of door system 10 has been lowered inward by pivoting on the lower RF track roller ball assemblies 40 in track roller sleeves 44. To allow for this pivot, the operation of closing or opening door system 10 is stopped, by control assembly 17 when RF shielding door leaf 12 is aligned with the aperture for the RF shielding door frame, but either before insertion or after retraction of RF shielding door leaf 12. At this position, the upper track roller ball 41 is removed, and track rollers 77 are removed from cam brackets 45. This pivot can be assisted further by attaching a receiving mount 85 to the top of RF shielding door leaf 12, with mount 85 operable to connect with a chain or other lifting means from a hoist. RF shielding door leaf 12 can be lowered onto a maintenance cart. Once lowered onto a maintenance cart, the plates 62 can be removed from the corresponding lower track roller sleeves 77, and RF shielding door leaf 12 can be rolled clear of the door systems.

The method of controlling the sealing of sliding door assembly 10 involves the steps of, first, providing the components of sliding door assembly 10. Additional steps include:

a. activating the drive tube assembly through the control assembly to move the mechanical door leaf frame and RF shielding door leaf from the open position to the closed position;

b. triggering activation of the mechanical insertion and retraction assembly through the control assembly, when the mechanical door leaf frame and RF shielding door leaf are in the closed position, to insert the RF shielding door leaf from the internal aperture of the mechanical door leaf frame and into the internal aperture the RF shielding door frame; and c. triggering activation of the air regulator assembly, when the RF shielding door leaf is fully inserted into the internal aperture the RF shielding door frame, to inflate the air seals around the RF shielding door leaf and form a HEMP-shielded door.

Further steps in the method of sealing sliding door assembly 10 include:

d. activating an air exhaust assembly to deflate the at least one HEMP shielding inflatable air seal around the RF shielding door leaf and form a HEMP-shielded door.

e. triggering activation of the mechanical insertion and retraction assembly through the control assembly, upon deflation of the at least one HEMP shielding inflatable air seal, to retract the RF shielding door leaf from the internal aperture the RF shielding door frame and into the internal aperture of the mechanical door leaf frame; and f. triggering activation of the drive tube assembly through the control assembly, when the RF shielding door leaf is fully retracted from the internal aperture the RF shielding door frame and into the internal aperture of the mechanical door leaf frame to move the mechanical door leaf frame and RF shielding door leaf from the closed position to the open position.

The method can further include the step of pivoting the RF shielding door leaf, in a closed position within mechanical door leaf frame, inward on one track ball assembly and corresponding track roller sleeve located at opposite sides of the RF shielding door leaf conducting maintenance on the RF shielding door leaf and at least one seal.

It will be understood that each of the elements and steps of the invention described above, or two or more together, may also find a useful application in other types of applications differing from the types described above. While the invention has been illustrated and described as embodied in the referenced Figures, however, it is not limited to the details shown, since it will be understood that various omissions, modifications, substitutions and changes in the forms and details of the system illustrated and its method of operation can be made by those skilled in the art without departing in any way from the spirit of the present invention.

What is claimed is:

1. A sliding door assembly shielded against a high-altitude electromagnetic pulse ("HEMP"), the assembly comprising:

an RF shielding door frame with electromagnetic shielding that blocks radio frequency electromagnetic radiation ("RF shielding"), the RF shielding door frame oriented in a substantially vertical plane with an internal aperture and having a head and side jams, and the RF shielding door frame mounted on an RF shielding floor plate with a longitudinal rail parallel to the vertical plane of the RF shielding door frame;

a mechanical door leaf frame oriented in a substantially vertical plane parallel to the vertical plane of the RF shielding door frame, the mechanical door leaf frame having an internal aperture and top, bottom and two side frame members, and the bottom frame member of the mechanical door leaf frame slidably mounted on the longitudinal rail of the RF shielding floor plate;

an RF shielding door leaf slidably mounted within the internal aperture of the mechanical door leaf frame, the RF shielding door leaf having an outer frame with an upper frame member, a lower frame member and two side members, each side member with an internal side, an outside perimeter to the RF shielding door leaf frame, and at least one HEMP shielding inflatable air seal attached around the perimeter of the RF shielding door leaf;

a drive tube assembly comprising an external frame mounted to the head of the RF shielding door frame and a drive assembly connected to the top frame member of the mechanical door leaf frame and operable to control a sliding motion of the mechanical door leaf frame, including the RF shielding door leaf, in the vertical plane of the mechanical door leaf frame and between an open position and a closed position, wherein, at the closed position, the internal aperture of the mechanical door leaf frame aligns with the internal aperture of the RF shielding door frame in the closed position;

a mechanical insertion and retraction assembly mounted on the RF shielding door leaf and the mechanical door leaf frame and that is operable to slidably extend the RF shielding door leaf from the internal aperture of the mechanical door leaf frame and into the internal aperture of the RF shielding door frame and also to slidably retract the RF shielding door leaf from the internal aperture of the RF shielding door frame and into the internal aperture of the mechanical door leaf frame; and a control assembly mounted on the drive tube assembly, the control assembly comprising a motor and an air regulator assembly, the motor operable to activate and control the drive tube assembly and the mechanical insertion and retraction assembly, and the air regulator assembly operable to control inflation and deflation of the at least one HEMP shielding inflatable air seal, whereby the at least one HEMP shielding inflatable air seal is inflated when the RF shielding door leaf is fully extended into the internal aperture of the RF shielding door frame and the least one HEMP shielding inflatable air seal is deflated before the RF shielding door leaf is retracted from the internal aperture of the RF shielding door frame.

2. The sliding door assembly of claim 1, wherein the control assembly further comprises a motor drive having an integral programmable logic controller.

3. The sliding door assembly of claim 1, wherein the mechanical insertion and retraction assembly further comprises an air exhaust assembly operable to deflate the at least one HEMP shielding inflatable air seal and retract the RF shielding door leaf from the RF shielding door frame upon activation or if power to the sliding door assembly is lost.

4. The sliding door assembly of claim 1, wherein the mechanical insertion and retraction assembly further comprises:

at least two track roller ball assemblies mounted at each side frame member of the RF shielding door leaf and at least two corresponding track roller sleeves mounted on each internal side of each side frame member of the mechanical door leaf frame, whereby each track roller ball assembly slidably rests in the corresponding track roller sleeve;

at least one cam roller pivotably connected to each internal side of the mechanical door leaf frame and slidably engaged with a corresponding cam bracket attached at each side frame member of the RF shielding door leaf;

a rod connecting each cam roller to a cam activator, the cam activator controlled by the control assembly whereby the cam activator operates to move each rod upward and the upward movement of each rod causes each cam roller to pivot and insert the RF shielding door leaf from the internal aperture of the mechanical door leaf frame and into the internal aperture of the RF shielding door frame.

5. The sliding door assembly of claim 4, wherein each cam activator includes at least one air cylinder that is activated by the air regulator assembly.

6. The sliding door assembly of claim 5, wherein the air regulator assembly activates and controls each at least one air cylinder.

7. The sliding door assembly of claim 4, wherein, when the internal aperture of the mechanical door leaf frame aligns with the internal aperture of the RF shielding door frame in the closed position and before the RF shielding door leaf is inserted into the RF shielding door frame, the RF shielding door leaf can pivot inward on one track roller ball assembly and corresponding track roller sleeve located at opposite sides of the RF shielding door leaf;

whereby maintenance of the RF shielding door leaf and at least one HEMP shielding air inflatable inflatable air seal can be conducted.

8. The sliding door assembly of claim 1, wherein the mechanical door leaf frame further comprises at least two wheels attached to the bottom frame member of the mechanical door leaf frame and configured to interact with and move along the longitudinal rail.

9. The sliding door assembly of claim 1, wherein the drive tube assembly comprises a timing belt, a timing belt tensioner, a timing belt coupler that connects to the upper top frame member of the mechanical door leaf frame and a rotary drive wheel connected to the motor, whereby the motor controls the sliding movement of the timing belt coupler and the mechanical door leaf frame.

10. A sliding door assembly shielded against a high-altitude electromagnetic pulse ("HEMP"), the assembly comprising:

an RF shielding door frame with electromagnetic shielding that blocks radio frequency electromagnetic radiation ("RF shielding"), the RF shielding door frame oriented in a substantially vertical plane with an internal aperture and having a head and side jams, and the RF shielding door frame mounted on an RF shielding floor plate;

a mechanical door leaf frame oriented in a substantially vertical plane parallel to the vertical plane of the RF shielding door frame, the mechanical door leaf frame having an internal aperture and slidably mounted on the RF shielding floor plate;

an RF shielding door leaf slidably mounted within the internal aperture of the mechanical door leaf frame, the RF shielding door leaf having at least one HEMP shielding inflatable air seal attached around the perimeter of the RF shielding door leaf;

a drive tube assembly mounted to the RF shielding door frame and operably connected to the top frame member of the mechanical door leaf frame, whereby the drive tube assembly controls the sliding motion of the mechanical door leaf frame, including the RF shielding door leaf, in the vertical plane of the mechanical door leaf frame and between an open position and a closed position, and wherein, at the closed position, the internal aperture of the mechanical door leaf frame aligns with the internal aperture of the RF shielding door frame in the closed position;

a mechanical insertion and retraction assembly mounted on the RF shielding door leaf and the mechanical door leaf frame and that is operable to slidably extend the RF shielding door leaf from the internal aperture of the mechanical door leaf frame and into the internal aperture of the RF shielding door frame and also to slidably retract the RF shielding door leaf from the internal aperture of the RF shielding door frame and into the internal aperture of the mechanical door leaf frame; and a control assembly mounted on the drive tube assembly, the control assembly comprising a motor and an air regulator assembly, the motor operable to activate and control the drive tube assembly and the mechanical insertion and retraction assembly, and the air regulator assembly operable to control inflation and deflation of the at least one HEMP shielding inflatable air seal, whereby the at least one HEMP shielding inflatable air seal is inflated when the RF shielding door leaf is fully extended into the internal aperture of the RF shielding door frame and the least one HEMP shielding inflatable air seal is deflated before the RF shielding door leaf is retracted from the internal aperture of the RF shielding door frame.

11. A method of controlling the sealing of a sliding door assembly shielded against a high-altitude electromagnetic pulse ("HEMP"), the method comprising:

providing an RF shielding door frame with electromagnetic shielding that blocks radio frequency electromagnetic radiation ("RF shielding"), the RF shielding door frame oriented in a substantially vertical plane with an internal aperture and having a head and side jams, and the RF shielding door frame mounted on an RF shielding floor plate with a longitudinal rail parallel to the vertical plane of the RF shielding door frame;

providing a mechanical door leaf frame oriented in a substantially vertical plane parallel to the vertical plane of the RF shielding door frame, the mechanical door leaf frame having an internal aperture and top, bottom and two side frame members, and the bottom frame member of the mechanical door leaf frame slidably mounted on the longitudinal rail of the RF shielding floor plate;

providing an RF shielding door leaf slidably mounted within the internal aperture of the mechanical door leaf frame, the RF shielding door leaf having an outer frame with an upper frame member, a lower frame member and two side members, each side member with an internal side, an outside perimeter to the RF shielding door leaf frame and at least one HEMP shielding inflatable air seal attached around the perimeter of the RF shielding door leaf;

providing a drive tube assembly comprising an external frame mounted to the head of the RF shielding door frame and a drive assembly connected to the top frame member of the mechanical door leaf frame and operable to control a sliding motion of the mechanical door leaf frame, including the RF shielding door leaf, in the vertical plane of the mechanical door leaf frame and between an open position and a closed position, wherein, at the closed position, the internal aperture of the mechanical door leaf frame aligns with the internal aperture of the RF shielding door frame in the closed position;

providing a mechanical insertion and retraction assembly mounted on the RF shielding door leaf and the mechanical door leaf frame and that is operable to slidably insert the RF shielding door leaf from the internal aperture of the mechanical door leaf frame and into the internal aperture the RF shielding door frame and also to slidably retract the RF shielding door leaf from the internal aperture of the RF shielding door frame and into the internal aperture of the mechanical door leaf frame;

providing a control assembly mounted on the drive tube assembly, the control assembly comprising a motor and an air regulator assembly, the motor operable to activate and control the drive tube assembly and the mechanical insertion and retraction assembly, and the air regulator assembly operable to control inflation and deflation of the at least one HEMP shielding inflatable air seal, whereby the at least one HEMP shielding inflatable air seal is inflated when the RF shielding door leaf is fully extended into the internal aperture of the RF shielding door frame and the least one HEMP shielding inflatable air seal is deflated before the RF shielding door leaf is retracted from the internal aperture of the RF shielding door frame;

activating the drive tube assembly through the control assembly to move the mechanical door leaf frame and RF shielding door leaf from the open position to the closed position;

triggering activation of the mechanical insertion and retraction assembly through the control assembly, when the mechanical door leaf frame and RF shielding door leaf are in the closed position, to insert the RF shielding door leaf from the internal aperture of the mechanical door leaf frame and into the internal aperture of the RF shielding door frame; and triggering activation of the air regulator assembly, when the RF shielding door leaf is fully inserted into the internal aperture the RF shielding door frame, to inflate the air seals around the RF shielding door leaf and form a HEMP-shielded door.

12. The method of claim 11, wherein the control assembly further comprises a motor drive having an integral programmable logic controller.

13. The method of claim 11, wherein the step of providing the mechanical insertion and retraction assembly further comprises the step of providing an air exhaust assembly operable to deflate the at least one HEMP shielding inflatable air seal and retract the RF shielding door leaf from the RF shielding door frame upon activation or if power to the sliding door assembly is lost, and the method further comprises the step of activating deflation of the at least one HEMP shielding air inflatable seal.

14. The method of claim 11, wherein the step of providing the mechanical insertion and retraction assembly further comprises:

providing at least two track roller ball assemblies mounted at each side frame member of the RF shielding door leaf and at least two corresponding track roller sleeves mounted on each internal side of each side frame member of the mechanical door leaf frame, whereby each track roller ball assembly slidably rests in the corresponding track roller sleeve;

providing at least one cam roller pivotably connected to each internal side of the mechanical door leaf frame and slidably engaged with a corresponding cam bracket attached at each side frame member of the RF shielding door leaf;

providing a rod connecting each cam roller to a cam activator, the cam activator controlled by the control assembly whereby the cam activator operates to move each rod upward and the upward movement of each rod causes each cam roller to pivot and insert the RF shielding door leaf from the internal aperture of the mechanical door leaf frame and into the internal aperture of the RF shielding door frame.

15. The method of claim 14, wherein each cam activator includes at least one air cylinder that is activated by the air regulator assembly.

16. The method of claim 15, wherein the air regulator assembly activates and controls each at least one air cylinder.

17. The method of claim 14, further comprising the steps of pivoting the RF shielding door leaf inward on one track ball assembly and corresponding track roller sleeve located at opposite sides of the RF shielding door leaf, when the internal aperture of the mechanical door leaf frame aligns with the internal aperture of the RF shielding door frame in the closed position and before the RF shielding door leaf is inserted into the RF shielding door frame; and conducting maintenance on the RF shielding door leaf and the at least one HEMP shielding inflatable air seal.

18. The method of claim 11, wherein the mechanical door leaf frame further comprises at least two wheels attached to the bottom frame member of the mechanical door leaf frame and configured to interact with and move along the longitudinal rail.

19. The method of claim 11, wherein the drive assembly comprises a timing belt, a timing belt tensioner, a timing belt coupler that connects to the upper top frame member of the mechanical door leaf frame and a rotary drive wheel connected to the motor, whereby the motor controls the sliding movement of the timing belt coupler and the mechanical door leaf frame.

20. The method of claim 11, further comprising the steps of:

activating an air exhaust assembly to deflate the at least one HEMP shielding inflatable air seal around the RF shielding door leaf and form a HEMP-shielded door;

triggering activation of the mechanical insertion and retraction assembly through the control assembly, upon deflation of the at least one HEMP shielding inflatable air seal, to retract the RF shielding door leaf from the internal aperture of the RF shielding door frame and into the internal aperture of the mechanical door leaf frame; and triggering activation of the drive tube assembly through the control assembly, when the RF shielding door leaf is fully retracted from the internal aperture the RF shielding door frame and into the internal aperture of the mechanical door leaf frame, to move the mechanical door leaf frame and RF shielding door leaf from the closed position to the open position.

* * * * *